US007201105B2

(12) United States Patent
Nishihara et al.

(10) Patent No.: US 7,201,105 B2
(45) Date of Patent: Apr. 10, 2007

(54) CONVEYANCE APPARATUS USING MOVABLE BODIES

(75) Inventors: Shigeyoshi Nishihara, Shiga (JP); Toshiyuki Iba, Osaka (JP)

(73) Assignee: Daifuku Co., Ltd., Osaka (JP)

( * ) Notice: Subject to any disclaimer, the term of this patent is extended or adjusted under 35 U.S.C. 154(b) by 0 days.

(21) Appl. No.: 10/838,134

(22) Filed: May 3, 2004

(65) Prior Publication Data

US 2004/0216985 A1 Nov. 4, 2004

(30) Foreign Application Priority Data

May 1, 2003 (JP) ..... 2003-126093
May 1, 2003 (JP) ..... 2003-126094
May 1, 2003 (JP) ..... 2003-126095

(51) Int. Cl.
*B61B 12/00* (2006.01)

(52) U.S. Cl. ..... 104/172.3; 104/172.1

(58) Field of Classification Search ..... 104/162, 104/164, 165, 172.1, 172.2, 172.6, 172.5, 104/172.4, 173.3; 198/465.1, 465.3
See application file for complete search history.

(56) References Cited

U.S. PATENT DOCUMENTS 6,324,992 B1 * 12/2001 Morikiyo et al. ..... 104/172.3
6,330,952 B2 * 12/2001 Summa et al. ..... 213/62 R
2003/0159614 A1 * 8/2003 Sullivan et al. ..... 104/172.1

FOREIGN PATENT DOCUMENTS

| | | |
|---|---|---|
| EP | 0 738 673 A1 | 10/1996 |
| EP | 1 097 885 A1 | 5/2001 |
| EP | 1 232 967 A1 | 8/2002 |
| GB | 2 380 175 A | 4/2003 |
| JP | 63-194810 | 12/1988 |
| JP | H2-22904 | 2/1990 |
| JP | 07-025441 | 1/1995 |
| JP | 2001-260870 | 9/2001 |
| JP | 3086461 | 3/2002 |

* cited by examiner

*Primary Examiner*—Mark T. Le
(74) *Attorney, Agent, or Firm*—D. Peter Hochberg; Sean Mellino

(57) ABSTRACT

Guided devices are connected to the front and rear ends of the main body of a moving body. Each guided device is connected in a relatively rotatable fashion about a lateral axle to the lower part of a vertical shaft. A lateral roller supporting body is connected to the vertical shaft, and guide rollers supported and guided by guide bodies disposed in prescribed positions in a fixed path are provided on the right and left-hand ends of the roller support body. During movement, the roller supporting body connected to the vertical shaft too rotates integrally, and the axis of a lateral axle supporting the pair of right and left-hand guide rollers can be orientated orthogonal to the fixed path, whereby the guide rollers are able to rotate smoothly without causing slipping or frictional resistance. Thereby, the supporting unit can always be supported and guided smoothly in curved path sections.

20 Claims, 18 Drawing Sheets

CONVEYANCE APPARATUS USING MOVABLE BODIES

BACKGROUND OF THE INVENTION

1. Field of the Invention

The present invention relates to a conveyance apparatus using movable bodies, which includes a rail device and movable bodies capable of moving along a fixed path by being supported and guided by this rail device, each movable body having a main body provided with a supporting unit for an item to be conveyed and connected with guided devices that are supported and guided by the rail device at positions corresponding to the front and rear ends of the supporting unit.

2. Description of the Related Art

Conventionally, the composition illustrated in Japanese Unexamined Patent Publication No. 7-25441 has been proposed as a conveyance apparatus of this kind. In other words, the main body of a movable body capable of moving along a fixed path by being supported and guided on rails is formed by three frame bodies which are connected in a relatively rotatable fashion by means of connecting devices. The frame bodies each comprise a rectangular shaped body which is elongated in the direction of the fixed path, and the side faces thereof are formed as passive surfaces. The middle frame body is provided with a conveyed item supporting unit and guided devices which are supported and guided by the rails, and the front and rear side frame bodies are each provided with a guided device which is supported and guided by the rails.

In this case, all (four) of the guided devices are formed in a trolley structure including vertical pins installed rotatably on the respective end frame members provided in the frame body, a trolley main body connected rotatably to the lower ends of these vertical pins by means of lateral pins, total four supported rollers installed on both sides of the trolley main body in front and rear pairs, and a total of four guided rollers installed on the upper and lower sides of the trolley main body in front and rear pairs.

Idle wheels are installed on the lower side of the item supporting unit, and a pair of guide rails which support these idle wheels from below are provided along a fixed path. These rails have a channel shape, and are provided as a right and left-hand pair of rails, with open sections of the respective rails mutually facing each other. A guide frame body for guiding an upper guided roller is fixed to the upper edge section of the open section of each rail, and a guide frame body for guiding a lower guided roller is fixed to the lower edge section.

If a conventional structure of this kind is adopted, the movable body is moved along a fixed path by means of the group of supported rollers of the respective guided devices being supported and guided by the rails, and by means of the group of guided rollers being guided by the guide frame body. Moreover, the weight of the item supporting unit is supported by means of the idle wheels being supported and guided by the guide rails.

However, according to the conventional composition described above, the groups of idle wheels are disposed in a fixed state in an uniform posture (orientation) with respect to the item supporting unit. Therefore, in a curved path which turns in the right or leftward direction in a plan view, the central axis linking the right and left-hand idle wheels is orientated in parallel with the radius of the curve. In other words, the group of idle wheels are orientated in a direction that is inclined with respect to the curved path of the guide rails, and therefore, there may arise such cases that the group of idle wheels produce frictional rotation, accompanied by slipping (friction resistance), which causes movement to be hard to be smooth due to the frictional rotation occurring at a plurality of positions. Therefore, the item supporting unit may be supported and guided along the guide rails whilst toppling or catching with respect to the guide rails, and therefore the movement of the movable body along the curved path cannot be performed smoothly. Further, the composition and disposition (configuration) of the guide rails in the curved path differs from that in a linear path, and therefore the installation of the guide rails in the curved path becomes complicated and expensive.

According to the conventional composition described above, since the guided devices are connected by inserting the lower ends of vertical pins bearing weight into the trolley main body, such a composition is obtained that is liable to produce toppling in the coupling sections. Therefore, especially when a large (wide or high) item having an unbalanced load is being conveyed, the inclination of the item supporting unit, in other words, the conveyed item, will increase, and there is a risk that problems will occur in the stability of the conveyance operation. In order to resolve such problems, it is necessary to adopt large and expensive guided devices which have the strength to support large loads. Accordingly, the guided devices become expensive, that is, the overall device becomes expensive.

Moreover, according to the conventional composition described above, the same structure is adopted for all of the guided devices, with the aim of achieving standardization of components. In this case, however, the same composition as of the middle section guided devices is adopted, which is strong enough to bear high loads and is expensive, for the guided devices at the front and rear ends where the load is small, so that the overall device becomes expensive. Moreover, since the front and rear pairs of guided rollers of the guided devices are guided by the guide frame body, the guided devices rotate relatively about the vertical pins with respect to the longitudinal direction of the frame body, in a curved path which turns in the right or leftward direction in plan view. In this case, all of the total of four supported rollers in the guided devices in the end sections, in particular, become orientated in parallel to the tangent to the curve in the region of the vertical pins, in other words, the supported rollers are orientated in a direction that diverges from the direction of movement of the frame body. Accordingly, the group of supported rollers perform frictional rotation, accompanied by slipping (frictional resistance), and hence there may be such cases that the movement cannot be performed smoothly due to the frictional rotation at these four points. Therefore, the guided devices may topple or catch with respect to the guide rails while being guided along the rails, and hence the movement of the movable body along a curved path section may not be performed smoothly.

SUMMARY OF THE INVENTION

It is an object of the present invention to provide a conveyance apparatus using movable bodies whereby movement of the movable body can be performed smoothly, at all times, even in a curved path.

It is also an object of the present invention to provide a conveyance apparatus using movable bodies, of which entire structure is simple and inexpensive, and which includes the installation of the guide rails and the like, in which the inclination of an item supporting unit can be reduced, while ensuring smooth supporting and guiding of the supporting unit even in a curved path.

In order to achieve the aforementioned object, the conveyance apparatus using movable bodies according to the present invention is a conveyance apparatus using movable bodies, comprising a rail device, movable bodies capable of moving along a fixed path by being supported and guided by this rail device, a supporting unit for a conveyed item being provided on the main body side of each movable body, and guided devices supported and guided by the rail device, the guided devices being connected to each movable body at positions corresponding to the front and rear ends thereof, wherein each guided device is connected in a relatively rotatable fashion via a lateral axle to the lower part of a vertical shaft extending from the main body, the vertical shaft is connected with a lateral roller supporting body, and guide rollers, which are supported and guided by guide bodies disposed at prescribed positions in the fixed path, are provided at the right and left-hand ends of this roller supporting body.

According to the composition of the present invention described above, when a movable body moves by means of a motive force being imparted to the same, the respective guided devices can be supported and guided by the rail device, via the respective supported rollers, and the weight of the supporting unit (which involves a large load) can be supported stably at all times by means of guided devices having a strong composition wherein supported rollers are provided in a distributed fashion. The movable body can move in a similar manner in a curved path section turning in the leftward or rightward direction, and by means of the guided devices rotating integrally with the vertical shafts, the orientation thereof can change automatically in accordance with the leftward or rightward curve of the rail device. Hence the movable body can be moved smoothly in the curved path section. Moreover, if a curved path section inclined in an upward or downward direction is formed in the fixed path, then by means of the guided devices rotating in a relative fashion about the lateral axles with respect to the vertical shafts, the orientation thereof changes automatically in accordance with the upward or downward curve of the rail device and the movable body is able to move smoothly at all times.

When performing movement of this kind, the roller supporting body connected to the vertical shaft also rotates in integrally with the same, and the central axis of the axle supporting the right and left-hand pair of guide rollers can be orientated towards (made to coincide with) a direction orthogonal to the fixed path, whereby the guide rollers are able to rotate smoothly, without creating slipping (frictional resistance). Therefore, it is possible to support and guide the roller supporting member, without producing any catching, or play, with respect to the guide bodies. Hence the movable body supporting the conveyed item can be moved smoothly and stably, at all times. Moreover, the composition and disposition (configuration) of the guide bodies can be made the same throughout the whole length of the fixed path, and therefore, the guide bodies can be disposed in a simple and inexpensive fashion.

Moreover, in order to achieve the aforementioned object, the conveyance apparatus using movable bodies according to the present invention is a conveyance apparatus using movable bodies, comprising a rail device, movable bodies capable of moving along a fixed path by being supported and guided by this rail device, a supporting unit for a conveyed item being provided on the main body side of each movable body, and guided devices supported and guided by the rail device, the guided devices being connected to each movable body at positions corresponding to the front and rear ends thereof, wherein each guided device is connected in a relatively rotatable fashion about a lateral axle, to a lower double-arm section of a bracket connected to the lower part of a vertical shaft extending from the main body, with a trolley main body fitted in the lower double-arm section, and the trolley main body includes a pair of right and left-hand supported rollers supported and guided respectively by the rail device, in a distributed fashion in the front and rear direction with respect to the vertical shaft.

By adopting this composition of the present invention, the movable body can be made to move smoothly by imparting motive force to same, whilst the orientation thereof changes automatically in accordance with the leftward or rightward curve of the rail device, and furthermore, smooth movement can be achieved at all times, whilst the orientation of the movable body changes automatically in accordance with an upward or downward curve of the rail device. When movement of this kind is performed, since the trolley main body of each guided device is connected in a relatively rotatable fashion to the lower double-arm section of a bracket connected to the vertical shaft, by means of a lateral axle, then a composition is achieved in which play is not liable to arise in the coupling sections. Therefore, even if a large (wide or high) object or an object with an unbalanced load, is conveyed, the inclination of the supporting unit, namely, the inclination of the conveyed item, can be diminished (reduced), and conveyance can be performed in a stable fashion. In addition to this, various types of work operation can be performed with respect to the conveyed item, and the conveyed item can be loaded and unloaded, to and from the supporting unit, in an accurate fashion at all times. Moreover, the guided devices which cause the trolley main body to engage with the lower double-arm section become small and inexpensive. Therefore, the overall system can be composed inexpensively.

Furthermore, in order to achieve the objects described above, the conveyance apparatus using movable bodies according to the present invention is a conveyance apparatus using movable bodies, comprising a rail device, movable bodies capable of moving along a fixed path by being supported and guided by this rail device, a supporting unit for a conveyed item being provided on the main body side of each movable body, and guided devices supported and guided by the rail device, the guided devices being connected to each movable body at positions corresponding to the front and rear ends thereof, wherein the main body of each movable body comprises three or more frame bodies connected to each other in a relatively rotatable fashion via vertical shafts, and guided devices connected at positions corresponding to the front and rear ends of each frame body. Among these guided devices, the middle section guided devices each has a trolley main body connected to the main body, wherein the trolley main body includes supported rollers supported and guided by the rail device, and guided rollers guided by the rail device. The guided rollers are provided in a distributed fashion respectively at the front and rear of the trolley main body. And the end section guided devices have a trolley main body connected to the main body, wherein the trolley main body includes supported rollers supported and guided by the rail device at one position in the front and rear direction of the trolley main body. The guided rollers guided by the rail device are provided in a distributed fashion on the trolley main body in a distributed fashion at the front and rear of the supported rollers.

By adopting this composition of the present invention, when a movable body moves by means of a motive force being imparted to same, the respective guided devices can be supported and guided by the rail device, via the respective supported rollers, and can be guided by the rail device via the respective guided rollers. Hence the movement of the movable body can be performed in a stable fashion without producing play, or toppling. Therefore, various types of work operation can be performed with respect to the conveyed item supported on the supporting unit, and the conveyed item can be loaded and unloaded to and from the supporting unit, in an accurate fashion at all times. In this case, the weight of the supporting unit (which involves a large load) can be supported stably at all times by means of the middle section guided devices having a strong composition wherein supported rollers are provided in a distributed fashion. Furthermore, a prescribed overall length can be ensured for the movable body and the overall device can be constituted inexpensively, by means of adopting end section guided devices having a simple structure in which supported rollers are provided at one position only.

The movable body can also be moved in a similar manner in a curved path section turning to the right or to the left, and in this case, the respective frame bodies are able to move in a state in which they are turned relatively in the rightward or leftward direction, with respect to the vertical shaft. Hence it is possible to ensure smooth movement of the movable body in a curved path section, whilst being able to constitute a long main body, by means of a group of frame bodies. When moving in a curved path section of this kind, when the front and rear pair of guided rollers of the end section guided devices are guided by the rail device, the supported rollers provided at one location between the front and rear guided rollers are orientated in a direction that diverges from the direction of travel of the frame bodies. Therefore, they perform frictional rotation accompanied by slipping (frictional resistance). However, since this frictional rotation occurs at only one position in the front and rear direction, it does not have a very significant effect. Hence the end section guided devices can be supported and guided without producing any catching or play with respect to the rail device, thereby making it possible to achieve smooth movement of the movable body at all times in a curved path section.

DESCRIPTION OF THE PREFERRED EMBODIMENTS

Figure 1:
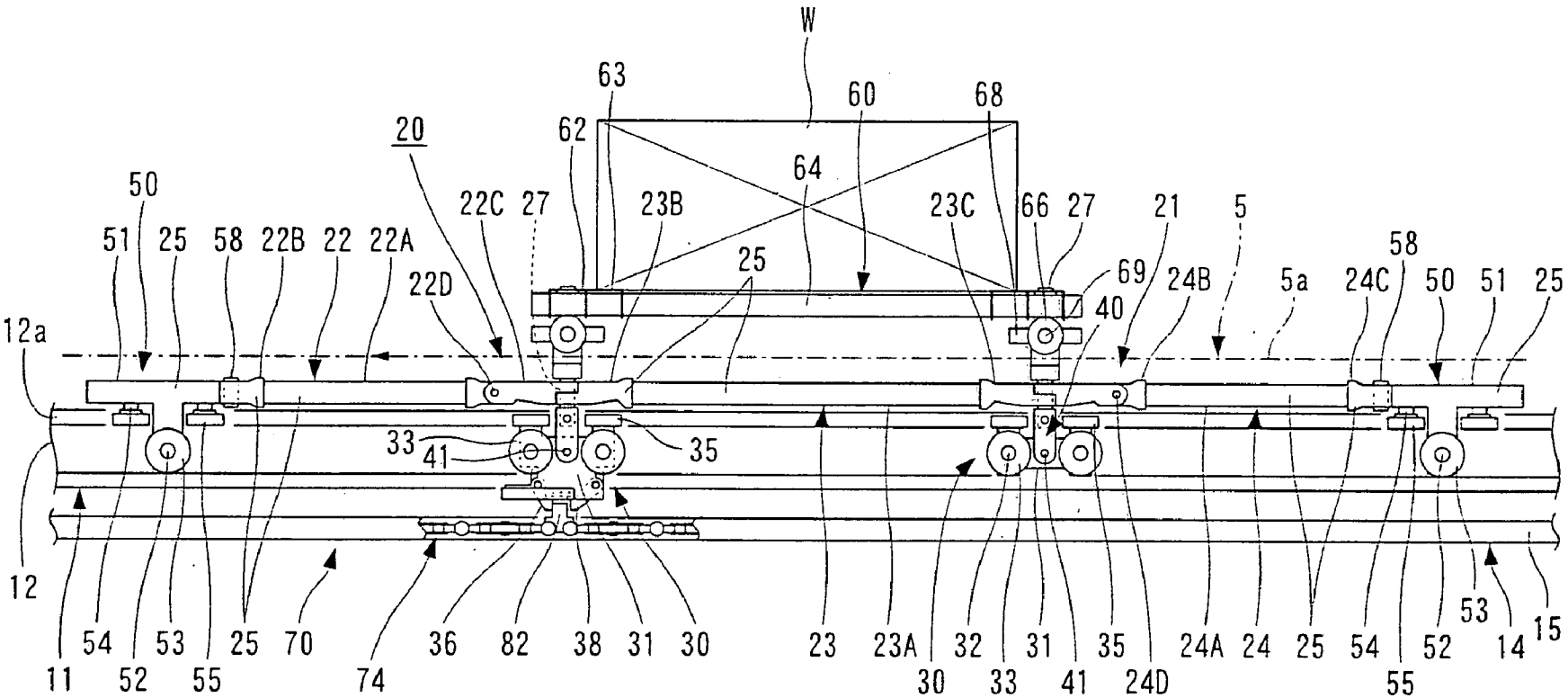
FIG. 1 is a partially cutaway side view of a principal part of a conveyance apparatus using movable bodies according to a first embodiment of the present invention.
Figure 2A:
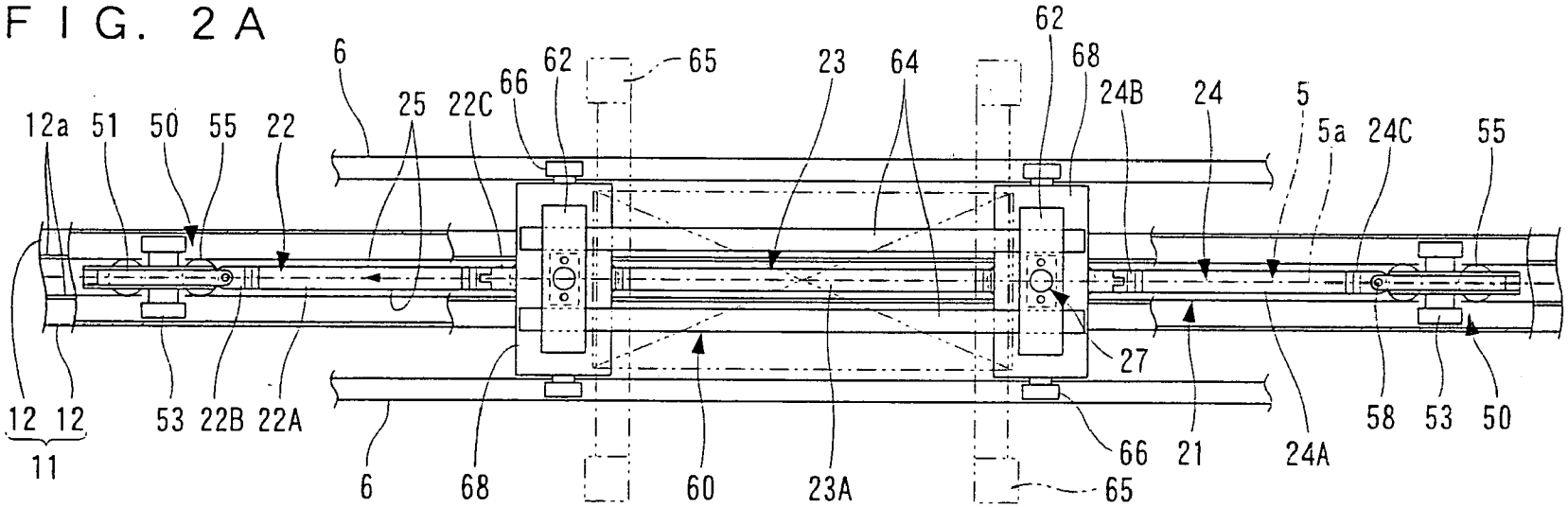
FIG. 2A is a partially cutaway plan view of the principal part of the conveyance apparatus using movable bodies.
Figure 2B:
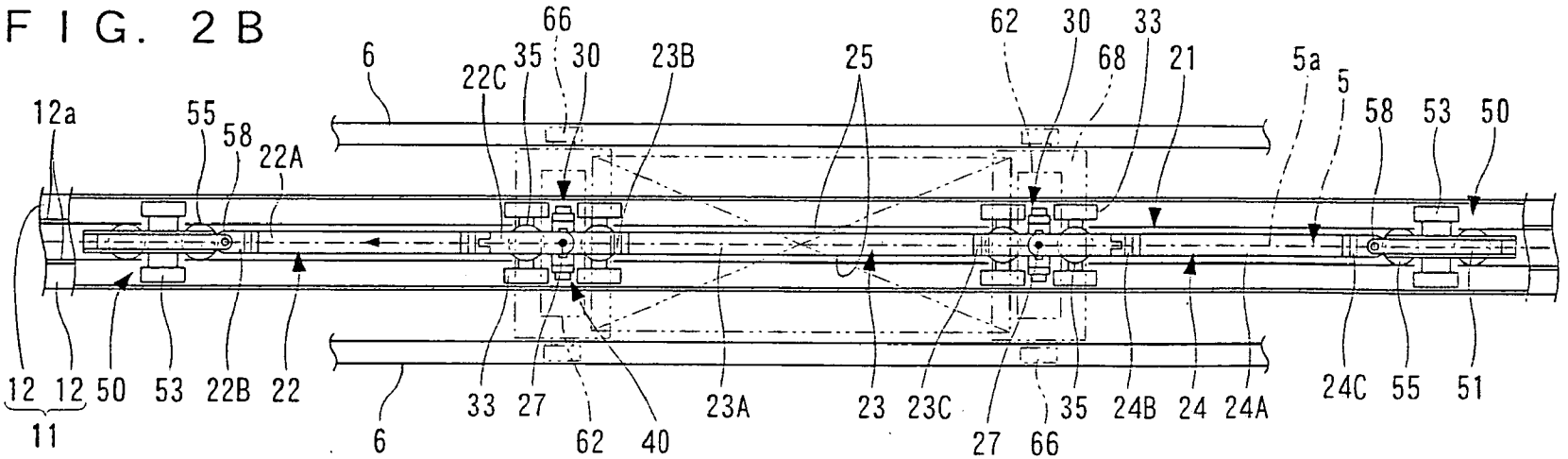
FIG. 2B is a plan view in horizontal section of the principal part of the conveyance apparatus using movable bodies.

Below, a first embodiment of the present invention will be described with reference to FIG. 1 to FIG. 12, relating to a mode where the invention is applied to a floor-mounted travel system.

In FIG. 1 to FIG. 5, FIG. 8 and FIG. 9, a rail device 11 is disposed on top of a machine frame 10 based on the floor 1. This rail device 11 is constituted by a pair of channel-shaped rails 12 positioned as a right and left-hand pair, the open sections of which are mutually facing. A guide section 12*a* is formed by bending the upper edge of the open section of each rail 12 in an upward direction, from the inner side thereof. A fixed path 5 is formed by the rail device 11, and here, the fixed path 5 is formed in an endless configuration, comprising, for example, in plan view, a pair of parallel linear path sections 5*a*, and curved path sections 5*b* running in the leftward and rightward direction and mutually connecting the start and end portions of the respective linear path sections 5*a*.

A movable body 20 is provided which is capable of moving along the fixed path 5 by being supported and guided by the rail device 11. The main body 21 of the movable body 20 is formed by three (three or more) frame bodies 22, 23, 24 connected in relatively rotatable fashion by means of vertical shafts (described hereinafter).

Here, the respective frame bodies 22, 23, 24 are formed by square tubular members (square bar members) 22A, 23A, 24A extending in the direction of the fixed path 5, front end members 22B, 23B, 24B connected to the front ends of these square tubular members 22A, 23A, 24A, and rear end members 22C, 23C, 24C connected to the rear ends of same. At least one side face thereof, in other words, the side faces thereof orientated towards the inner side of the endless fixed path 5, for example, are formed with laterally-orientated passive surfaces 25 along the whole length thereof or the majority thereof.

In the front frame body 22, the front end member 22B is formed integrally with the square tubular member 22A, and the rear end member 22C is connected to same, tiltably in an upward and downward direction, by means of a lateral pin 22D. Moreover, in the middle frame body 23, the front end member 23B and the rear end member 23C are formed integrally with the square tubular member 23A. In the rear frame body 24, the front end member 24B is connected to the square tubular member 24A, tiltably in an upward and downward direction, by means of a lateral pin 24D, and the rear end member 24C is formed integrally with the square tubular member 24A.

The front frame body 22 and the middle frame body 23, and the middle frame body 23 and the rear frame body 24, are connected together in a relatively rotatable fashion, by means of respective vertical shafts 27. Here, the vertical shafts 27 comprise an upper axle section 27*a*, a large diameter axle section 27*b* formed continuously from the lower end of the upper axle section 27*a*, an intermediate axle section 27*c* formed continuously from the lower end of the upper axle section 27*b*, and a lower axle section 27*d* formed continuously from the lower end of the intermediate axle section 27*c*, these respective parts being formed in an integral fashion. The vertical shaft 27 is composed in such a manner that is connected together with the rear end member 22*c* of the front frame body 22 and the front end member 23*b* of the middle frame body 23, or the rear end member 23*c* of the middle frame body 23 and the front end member 24*b* of the rear frame body 24, respectively, in a relatively rotatable fashion, by means of the intermediate axle section 27*c*.

The movable body 20 is supported and guided on the rail device 11 by means of a middle section guided device 30, and an end section guided device 50, in such a manner that it can move along the fixed path 5. In this case, the middle section guided device 30, and the end section guided device 50, are composed in a trolley structure.

More specifically, in the front and rear pair of middle section guided devices 30, a pair of front and rear lateral pins 32 are passed through and fixed to a trolley main body 31 in intermediate positions in the vertical direction thereof, and supported rollers 33 which engage with the rails 12 in the rail device 11 and are guided and supported by same are installed in an idly rotatable fashion on the respective projecting sections of these lateral pins 32. Moreover, a front and rear pair of vertical pins 34 are fixed to the top of the trolley main body 31, and guided rollers 35 which are guided by opposing the guide sections 12*a* of the rails 12 are installed in an idly rotatable fashion on the upper ends of the vertical pins 34. One example of a middle section guided device 30 is constituted by means of the aforementioned elements 31 to 35, and the like.

A lower double-arm section 40*a* of a bracket 40 is fitted over the trolley main body 31, in the central portion thereof in the front/rear direction, and a lateral axle 41 is passed from this lower double-arm section 40*a* and through the trolley main body 31, whereby the trolley main body 31 and the bracket 40 are connected in a relatively rotatable fashion. The upper tubular section 40*b* of the bracket 40 is formed with a through hole section 42 which is open at the upper and lower ends.

The lower axle section 27*d* of the vertical shaft 27 fits into this through hole section 42 formed in the bracket 40, and a lateral pin 43 is passed from the upper tubular section 40*b* of the bracket 40 and through the lower axle section 27*d*. Thereby, the trolley main body 31 of the middle section guided device 30 is connected in a relatively rotatable fashion to the lower double-arm section 40*a* of the bracket 40 connected to the lower axle section 27*d* of the vertical shaft 27, by means of the lateral axle 41. Respective right and left-hand pairs of supported rollers 33 and guided rollers 35 are provided in front of and behind the vertical shaft 27.

A passive body 36 is provided on the movable body 20. More specifically, a passive body 36 is provided in a vertically swingable fashion, in the foremost (at least one) of the middle section guided devices 30, on the lower front portion of the trolley main body 31, by means of a horizontal pin 37. This passive body 36 is formed with a passive surface 36*a* facing rearwards in the lower part thereof, a receiving surface 36*b* facing upwards in the middle portion thereof, and a stopper surface 36*c* facing rearwards in the upper part thereof. Here, a composition is adopted wherein, when the stopper surface 36*c* is abutted against the trolley main body 31, the passive surface 36*a* assumes a perpendicular passive attitude.

An shudder preventing body 38 is provided on the lower part and the rear portion of the trolley main body 31, in a vertically swingable fashion, by means of a horizontal pin 39. This shudder preventing body 38 is formed with an shudder preventing surface 38*a* facing forwards in the lower part thereof, an abutting surface 38*b* facing downwards in the middle portion thereof, a stopper surface 38*c* facing forwards, and a cam surface 38*d* facing downwards and rearwards, in the upper part thereof. Here, a composition is adopted wherein, when the stopper surface 38*c* is abutted against the trolley main body 31, the shudder preventing surface 38*a* opposes the passive surface 36*a* in a vertical state, and furthermore, the abutting surface 38*b* abuts against the receiving surface 36*b*, from above.

Furthermore, in the front and rear pair of end section guided devices 50, a horizontal pin 52 is passed through and fixed to a low position on the trolley main body 51 at one point (a central point) in the front/rear direction thereof, and supported rollers 53 which engage with the rails 12 of the rail device 11 and are supported and guided by same are installed in an idly rotatable fashion on the respective projecting sections of the horizontal pin 52. Furthermore, a front and rear pair of vertical pins 54 are fixed to the lower part of the trolley main body 51, and guided rollers 55 which are guided by opposing the guide sections 12*a* of the rails 12 are installed in an idly rotatable fashion on the lower end sections of these vertical pins 54. One example of a end section guided device 50 is constituted by the aforementioned elements 51–55, and the like.

The inner end portion of the trolley main body 51 is connected directly, in a relatively rotatable fashion, with the front end member (idle end section) 22B of the front frame body 22 or the rear end member (idle end section) 24C of the rear frame body 24, by means of a vertical pin 58. Thereby, the end section guided devices 50 have a trolley main body 51 that is connected to the main body 21, and supported rollers 53 that are supported and guided by the rail device 11 are provided in this trolley main body 51, in one position in the front/rear direction, in addition to which, guided rollers 55 that are guided by the rail device 11 are provided in a distributed fashion both in front of and to the rear of the supported rollers 53. In this case, a passive surface 25 is also formed on the side face of the trolley main body 51 of the end section guided device 50, in a continuous fashion with the main body 21.

A supporting unit 60 for a conveyed item W is provided on the main body 21 of the movable body 10. More specifically, a supporting unit 60 is provided on top of the respective front and rear pair of vertical shafts 27 which connected the front frame body 22 and the middle frame body 23, and the middle frame body 23 and the rear frame body 24, together in a relatively rotatable fashion. This supporting unit 60 comprises a rotating body 61 fitted over the upper axle section 27*a* of each of the respective vertical shafts 27, a bracket body 62 fixed to each rotating body 61, a conveyed item W supporting piece 63 provided on each of the bracket bodies 62, and a right and left-hand pair of longitudinal members 64 provided between the front and rear bracket bodies 62. Large-width supports 65 are provided detachably on the front and rear support pieces 63. One example of a supporting unit 60 is constituted by the aforementioned elements 61 to 65, and the like.

Idle wheels (guide rollers) 66 are installed on a portion of the aforementioned vertical shaft 27. More specifically, a cylindrical member 67 which abuts against the lower face of the rotating body 61 is fitted over the upper axle section 27*a*, such that it is free to rise and fall only (such that it rotates in unison with same), a lateral roller supporting body 68 being connected to this cylindrical member 67. This roller supporting body 68 has a frame-type shape, and axles 69 are provided projecting outwards in a leftward and rightward direction in the end sections thereof in the lateral direction, and in the center thereof in the front/rear direction, the aforementioned idle wheels 66 being installed on these axles 69. A pair of guide rails (one example of a guide body) 6 which support and guide the idle wheels 66 from beneath are disposed in prescribed positions in the aforementioned fixed path 5, in other words, in prescribed positions following a linear path section 5*a* or a curved path section 5*b*.

Figure 3:
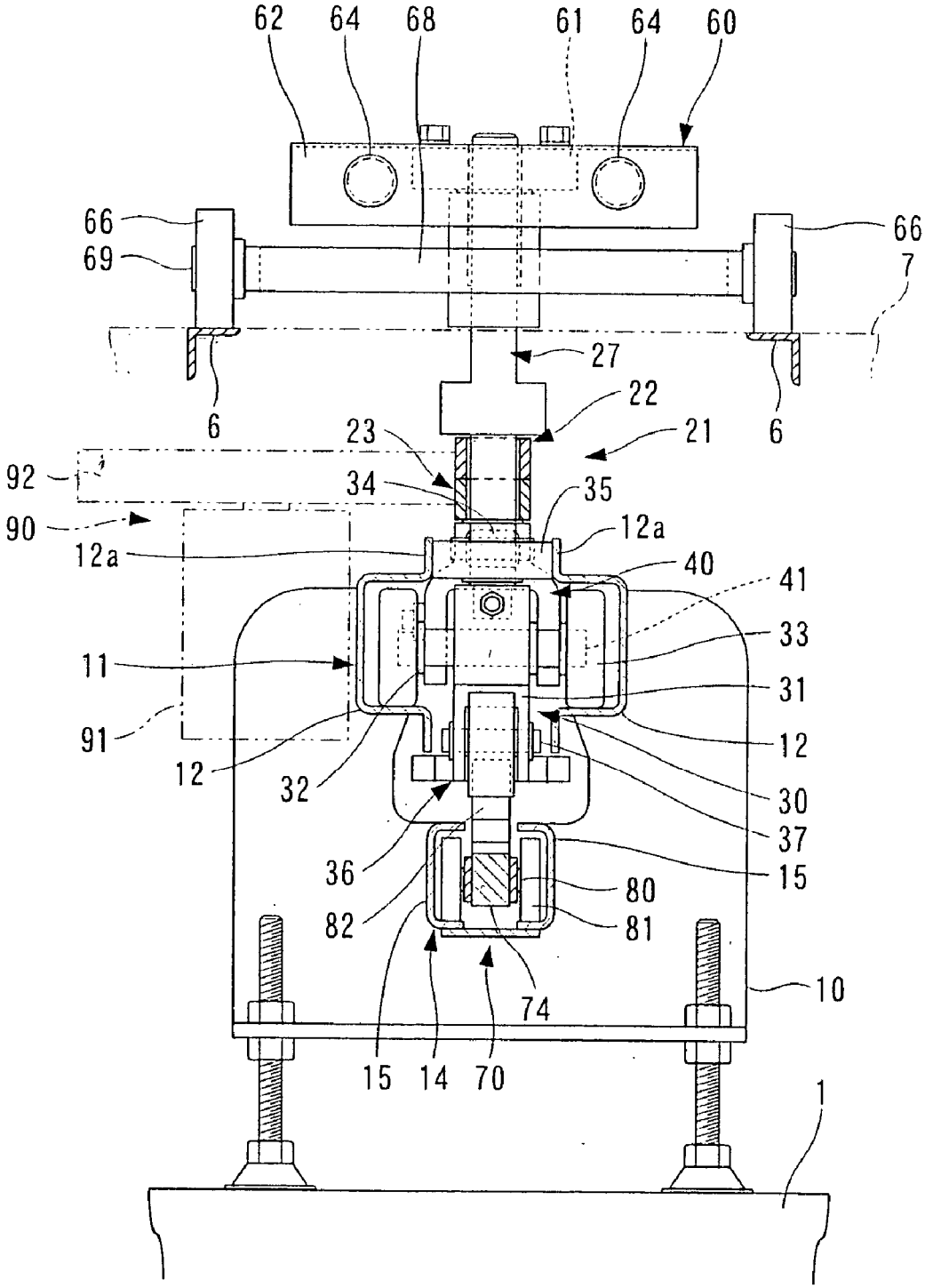
FIG. 3 is a partially cutaway front view of a principal part of an endless rotary type feed device section in the conveyance apparatus using movable bodies.

The guide rails 6 may be provided along the entire length of the fixed path 5, or they may be provided in desired positions where the conveyed item W is supported and work operations are carried out. Moreover, a cover body 7 is provided on a portion of each guide rail 6, and here, it is possible to achieve a shape for supporting and guiding the free wheels 66, by means of the cover body (further example of guide body) 7. Besides a four-wheel configuration as illustrated in FIG. 3, the free wheels 66 may also be provided in a plurality of configurations, such as a one-wheel configuration, a one-sided two-wheel configuration, a three-wheel configuration or a configuration of more than four wheels.

In the fixed path 5, for example, one of the linear path sections 5*a* passes through a drying one (one example of a processing section) 9 for drying the conveyed item W. An endless rotary type feed device 70, the transmitting body of which engages with and acts on the passive body 36, thereby imparting a motive force to the movable body 20, is provided in a position corresponding to the drying oven 9.

More specifically, for example, the endless rotary type feed device 70 is constituted by a drive gear wheel 71 provided at the output section of the drying oven 9, a group of idle gear wheels 72 provided at the input section of the drying oven 9, and elsewhere, a drive device 73 connected to the drive gear wheel 71, and a chain 74 wound about the respective gear wheels 71, 72, and the like. Here, the chain 74 is constituted in an endless fashion by coupling a group of pairs of upper and lower link members 75 and a group of pairs of right and left-hand link members 76, by means of chain pin members 77, and the coupling by the chain pin members 77 allows relative rotational movement in the vertical and lateral directions.

A horizontal guide roller 79 is provided between each pair of upper and lower link members 75, by means of a vertical pin 78, and vertical guide rollers 81 are provided in an idly rotatable fashion, on the outer side of each pair of right and left-hand link members 76, by means of horizontal pins 80. Moreover, a transmitting member 82 capable of engaging with the passive body 36 is provided between appropriate right and left-hand link members 76, and here, the transmitting member 82 is composed in such a manner that it projects upwards into the path section positioned thereabove.

In order to support and guide the chain 74 traveling through the path section above, a chain guide device 14 is provided below the rail device 11. More specifically, the chain guide device 14 is constituted by disposing channel-shaped rails 15 below the machine frame 10, in the form of a right and left-hand pair, the open sections of which are mutually facing. One example of an endless rotating feed device 70 is constituted by the aforementioned elements 14, 15, 71–82, and the like.

Friction type feed devices 90 which contact with and impart rotation to the passive surface 25, thereby imparting a motive force to the movable body 20, are provided in prescribed path sections of the fixed path 5. Each friction type feed device 90 is constituted by an induction motor 91 having a reduction gear mechanism, being one example of a rotary drive section, a feed roller 92 installed on an output shaft installed in a vertical direction from the inductor motor 91, and the like. The outer circumference of the feed roller 92 is made, for example, from urethane. One example of a frictional feed device 90 is constituted by the aforementioned elements 91, 92, and the like.

By means of the rotationally driven feed roller 92 contacting and acting on the passive surface 25, the frictional feed device 90 is able to impart a motive force to the movable body 20. In this case, the frictional feed devices 90 may be located in fixed positions, or in order to achieve more suitable contact force, for example, a configuration may be adopted wherein the feed roller 92 is pressed against the passive surface 25 by means of the elastic force of a compression spring, or the like. The frictional feed devices 90 are disposed at prescribed intervals in a prescribed path section of the fixed path 5, and the pitch P at which they are installed is set to a distance that is shorter that the overall length L of the movable body 20, in other words, $P<L$.

Figure 11:
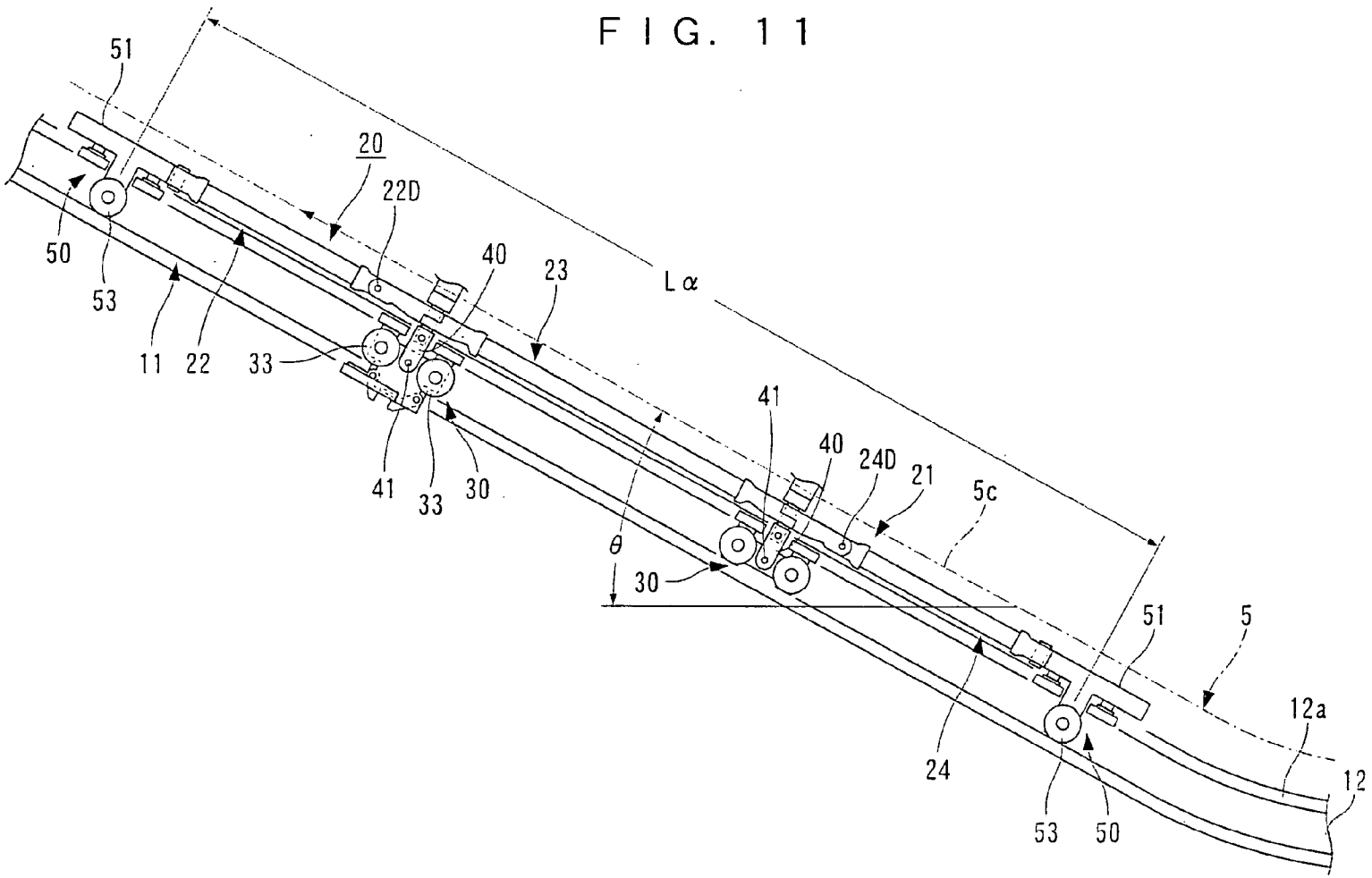
FIG. 11 is a side view of an ascending/descending path section in the conveyance apparatus using movable bodies.

As shown in FIG. 11, an ascending/descending path section (ascending path section or descending path section) 5*c* is formed in the fixed path 5, according to requirements. Here, the angle of gradient $\theta$ of the ascent or descent in the ascending/descending path section 5*c* is set in such a manner that it is smaller, the greater the distance $L\alpha$ between the respective supported rollers 53 in the front and rear end section guided devices 50.

In other words, as shown in Table 1, for example, if the distance $L\alpha$ between the supported rollers 53 is "4200", then the angle of gradient $\theta$ of the ascent or descent can be set up to around "30°", and if the distance Lα between the supported rollers 53 is "5200", then the angle of gradient θ of the ascent or descent can be set from "15°" to around "20°".

TABLE 1

| Distance Lα between supported rollers 53 | Angle θ 15° | 20° | 30° |
|---|---|---|---|
| 4200 | Yes | Yes | Yes |
| 4450 | Yes | Yes | Yes |
| 4700 | Yes | No | No |
| 4950 | Yes | No | No |
| 5200 | Yes | No | No |

Below, the action of the first embodiment described above will be explained.

Figure 9:
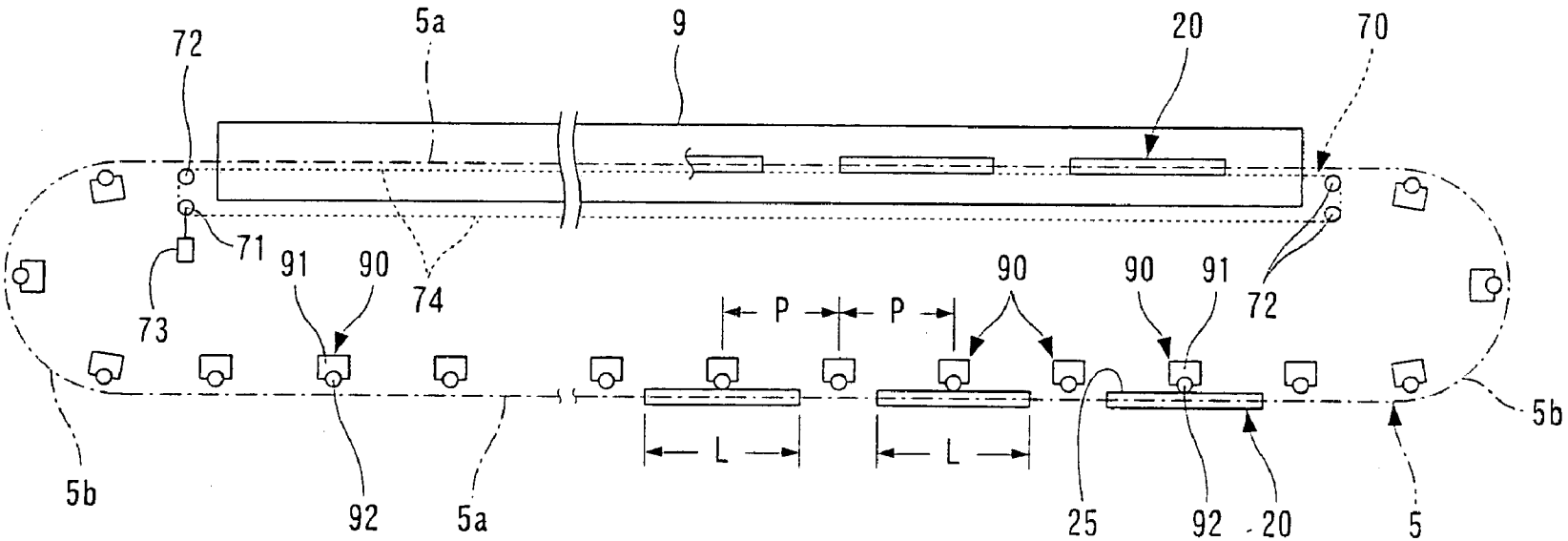
FIG. 9 is a schematic plan view of a fixed path in the conveyance apparatus using movable bodies.

As shown by the dotted lines in FIG. 3, and by FIG. 9, in prescribed path sections of the fixed path 5 with the exception of the drying oven 9, by means of a feed roller 92 contacting the passive surfaces 25 being driven in rotation by an induction motor 91, the friction type feed device 90 imparts a motive force (traveling force) to the movable body 20, whereby the movable body 20 is caused to move. More specifically, the movement of the movable body 20 by means of the frictional type feed device 90 is achieved by the feed roller 92 acting successively on the passive surface 25 of the end section guided device 50, the passive surface 25 of front frame body 22, the passive surface 25 of the middle frame body 23, the passive surface 25 of the rear frame body 24, and the passive surface 25 of the end section guided device 50.

In this case, if the feed roller 92 acts on the front frame body 22, then the middle frame body 23 and the rear frame body 24, and the like, are pulled and moved via the vertical shafts 27, and furthermore, if it acts on the middle frame body 23, then the front frame body 22 is pushed and caused to move via a vertical shaft 27, and the rear frame body 24 is pulled and caused to move via a vertical shaft 27, and moreover, if the feed roller 92 acts on the rear frame body 24, then the middle frame body 23 and the front frame body 22 are pushed and caused to move via the vertical shafts 27.

When movement (travel) of this kind is performed, the middle section guided device 30 and the end section guided device 50 are supported and guided on the respective supported rollers 33, 53, and the guided rollers 35, 55 confront the guide sections 12*a* and are guided by same. In so doing, since the trolley main body 31 of each middle section guided device 30 is connected in a relatively rotatable fashion to the lower double-arm section 40*a* of the bracket 40 connected to the lower axle section 27*d* of the vertical shaft 27, by means of a lateral axle 41, then a composition is achieved in which play is not liable to arise in the coupling sections.

Therefore, even if a large (wide or high) object, or an object with an irregular center of gravity, is conveyed as the conveyed item W, the inclination of the supporting unit 60, and namely, the inclination of the conveyed item W, can be diminished (reduced), and conveyance can be performed in a stable fashion, in addition to which various types of work operation can be performed with respect to the conveyed item W, and the conveyed item W can be loaded and unloaded, in an accurate fashion at all times. Moreover, the middle section guided devices 30, which cause the trolley main body 31 to engage with the lower double-arm section 40*a*, become small and inexpensive, and therefore the overall system can be composed inexpensively.

The movement of the movable body 20 described above is performed intermittently at the installation pitch P of the respective friction type feed devices 90, automatic control being implemented on the basis of detection signals from appropriate detecting means, or the like, in such a manner that the intermittent feed action is carried out when the downstream friction type feed device 90 is in an empty state. At the position of the friction type feed device 90, the movable body 20 is halted by the fact that the feed roller 92 is not rotating, and it is registered in position by appropriate position registering means, in which state, an operator situated on the floor 1, or an operator riding on the main body 21, carries out various work tasks with respect to the conveyed item W supported on the supporting unit 60.

Figure 10:
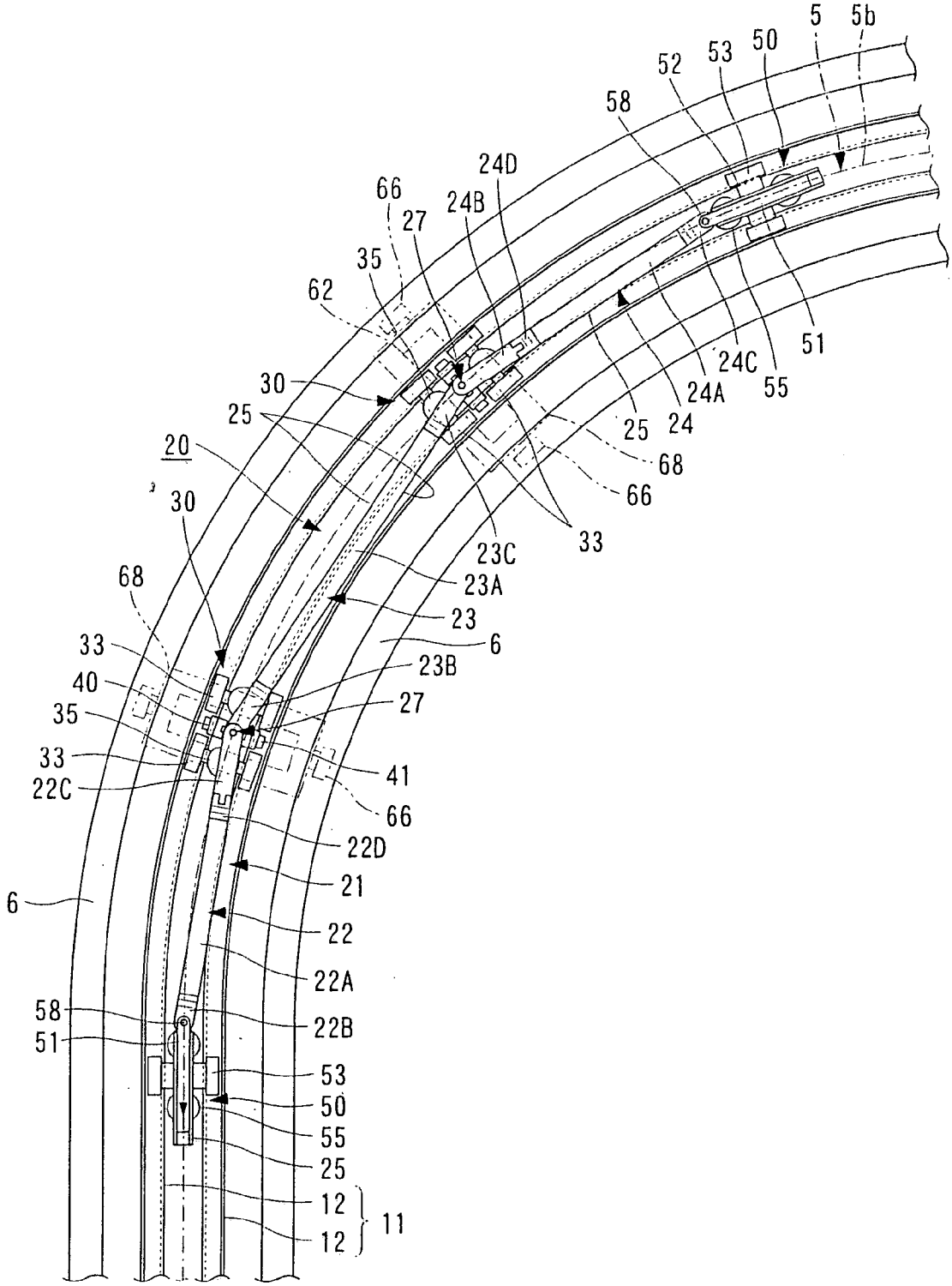
FIG. 10 is a plan view of a laterally curved path section in the conveyance apparatus using movable bodies.

The movement of the movable body 20 is performed in a similar manner in the curved path sections 5*b* which travel in the leftward or rightward direction. In this case, in the curved path sections 5*b*, as illustrated in FIG. 10, the frame bodies 22, 23, 24 are moved in a state in which they are each turned with respect to each other, in a leftward or rightward direction, via the vertical shafts 27. Moreover, the end section guided devices 50 are moved in a state in which they are turned with respect to the front and rear frame bodies 22, 24, in a leftward or rightward direction, via the vertical pins 58.

When moving along a curved path section 5*b* in this way, as shown in FIG. 10, the middle section guided devices 30 are supported and guided by the respective rails 12 of the rail device 11, by means of the respective supported rollers 33, and the respective guided rollers 35 confront and are guided by the guide sections 12*a*, whereby the middle section guided devices 30 are caused to rotate together with the vertical shafts 27, with respect to the main body 21. Accordingly, the middle section guided devices 30 are supported and guided without producing any catching, or play, with respect to the rails 12, and hence the movement of the movable body 20 along the curved path section 5*b* can be performed smoothly at all times.

In this case, as illustrated by the dotted lines in FIG. 10, each of the roller supporting bodies 68 connected to a vertical shaft member 27 also rotates in unison with same, whereby the central axis of the axles 69 supporting the idle wheels 66 can be orientated in (made to coincide with) the direction of the radius of the curve, and hence the idle wheels 66 are able to rotate smoothly, without being subject to slipping (frictional resistance). Therefore, the roller supporting body 68 is supported and guided without producing any catching, or play, with respect to the guide rails 6, and hence the movable body 20 supporting the conveyed item W can be moved stably and smoothly in a curved path section 5*b*, at all times.

Furthermore, the composition and positioning (configuration) of the guide rails 6 in the curved path sections 5*b* can be made the same as that in the linear path sections 5*a*, and therefore the guide rails 6 in the curved path sections 5*b* can be positioned simply and inexpensively.

If there is a change in the vertical interval between the guide rails 6 and the rail device 11, due to installation accuracy of the guide rails 6, or the like, then this difference can be absorbed by means of the cylindrical member 67 rising or falling with respect to the upper axle section 27*a*, and therefore, a stable supporting and guiding action can be achieved at all times.

Furthermore, when moving along a curved path section 5*b*, since the front and rear pair of guided rollers 55 are guided by the guide sections 12*a*, the end section guided devices 50 rotate relatively with respect to the longitudinal direction of the front and rear frame bodies 22, 24, about the vertical pins 58. In this case, the right and left-hand pair of supported rollers 53 provided at one position between the front and rear guided rollers 55 are orientated in parallel with a line linking the respective central axes of the vertical pins 54 on which the front and rear guided rollers 55 are installed, in other words, they are orientated in a direction that is inclined with respect to the direction of movement of the frame bodies 22, 24, and consequently, the supported rollers 53 perform frictional rotation accompanied by slipping (frictional resistance).

However, this frictional rotation does not have a very significant effect, because it occurs at one point in the front/rear direction and a total of two points in the lateral direction, and therefore, the end section guided devices 50 are supported and guided without producing any catching, or play, with respect to the rails 12, and hence the movable body 20 can be moved smoothly at all times in a curved path section 5*b*.

In this way, the movable body 20 having moved through the curved path section 5*b* arrives at the input section to the drying oven 9, and the passive body 36 thereof is inserted into the path of action of the endless rotary type feed device 70 and is halted. Here, an endless rotary type feed device 70 is operated in the area of the drying oven 9.

Figure 4:
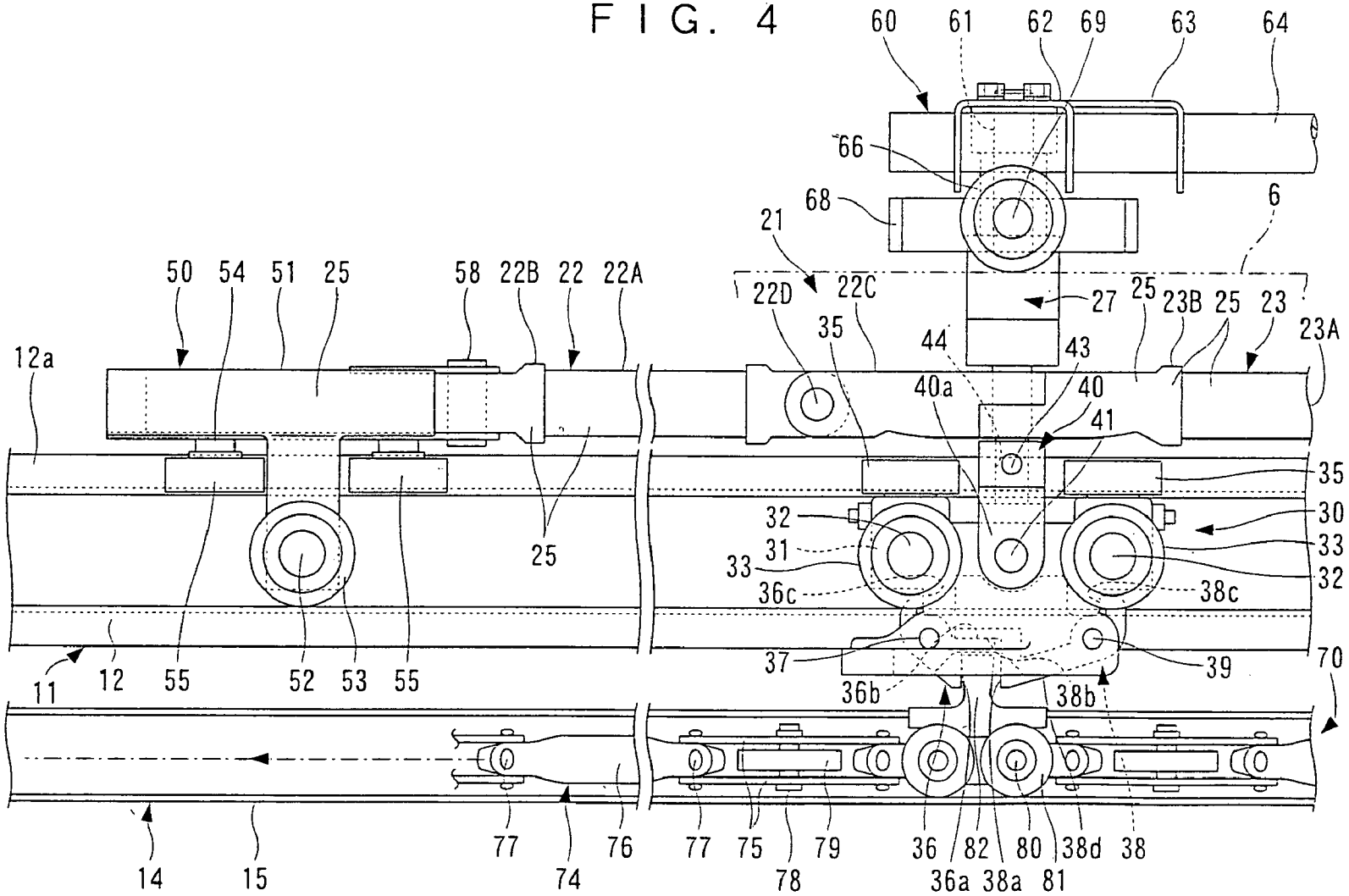
FIG. 4 is a partially cutaway side view of the principal part of the endless rotary type feed device section in the conveyance apparatus using movable bodies.
Figure 5:
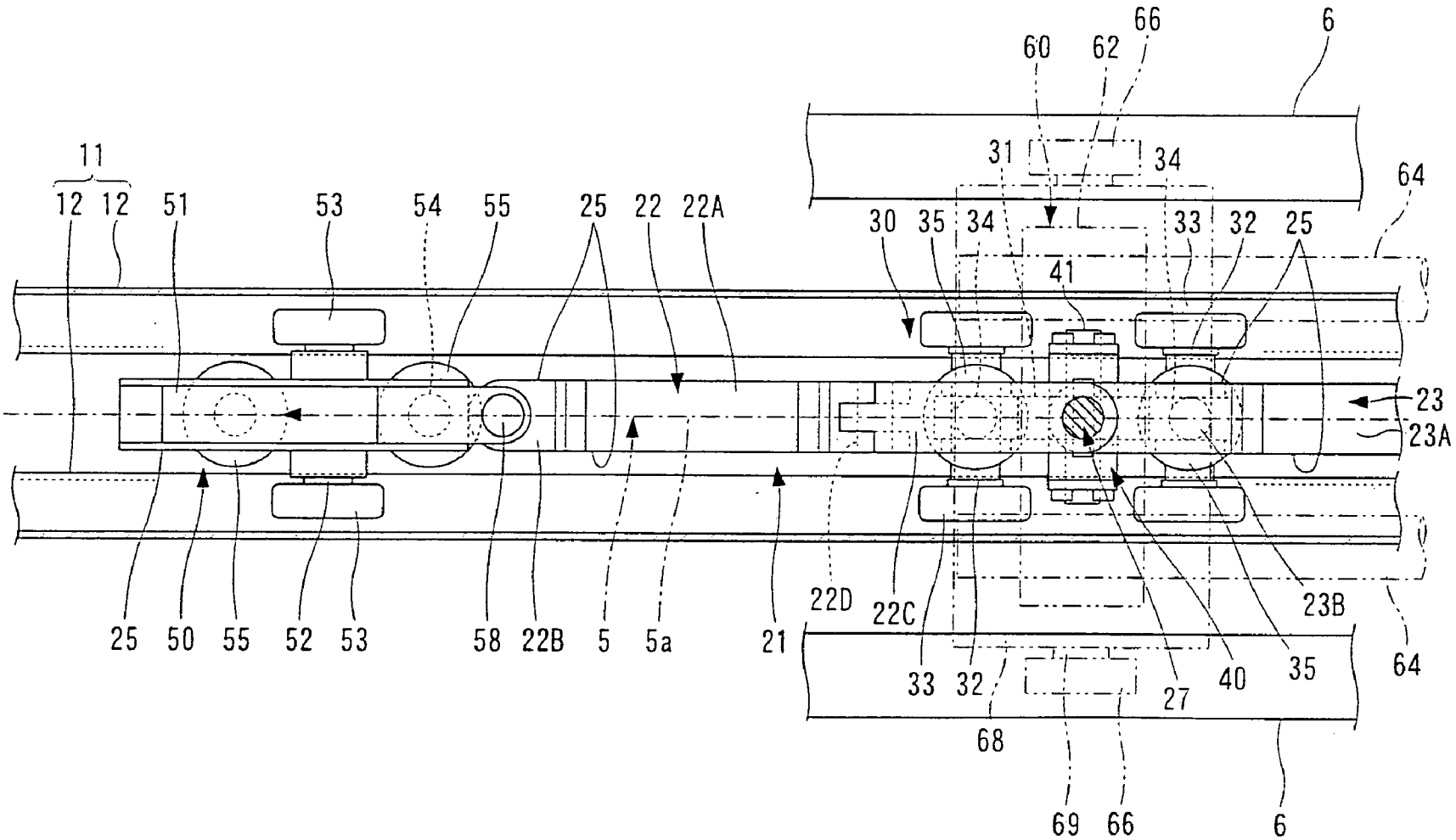
FIG. 5 is another partially cutaway plan view of the principal part of the conveyance apparatus using movable bodies.
Figure 6:
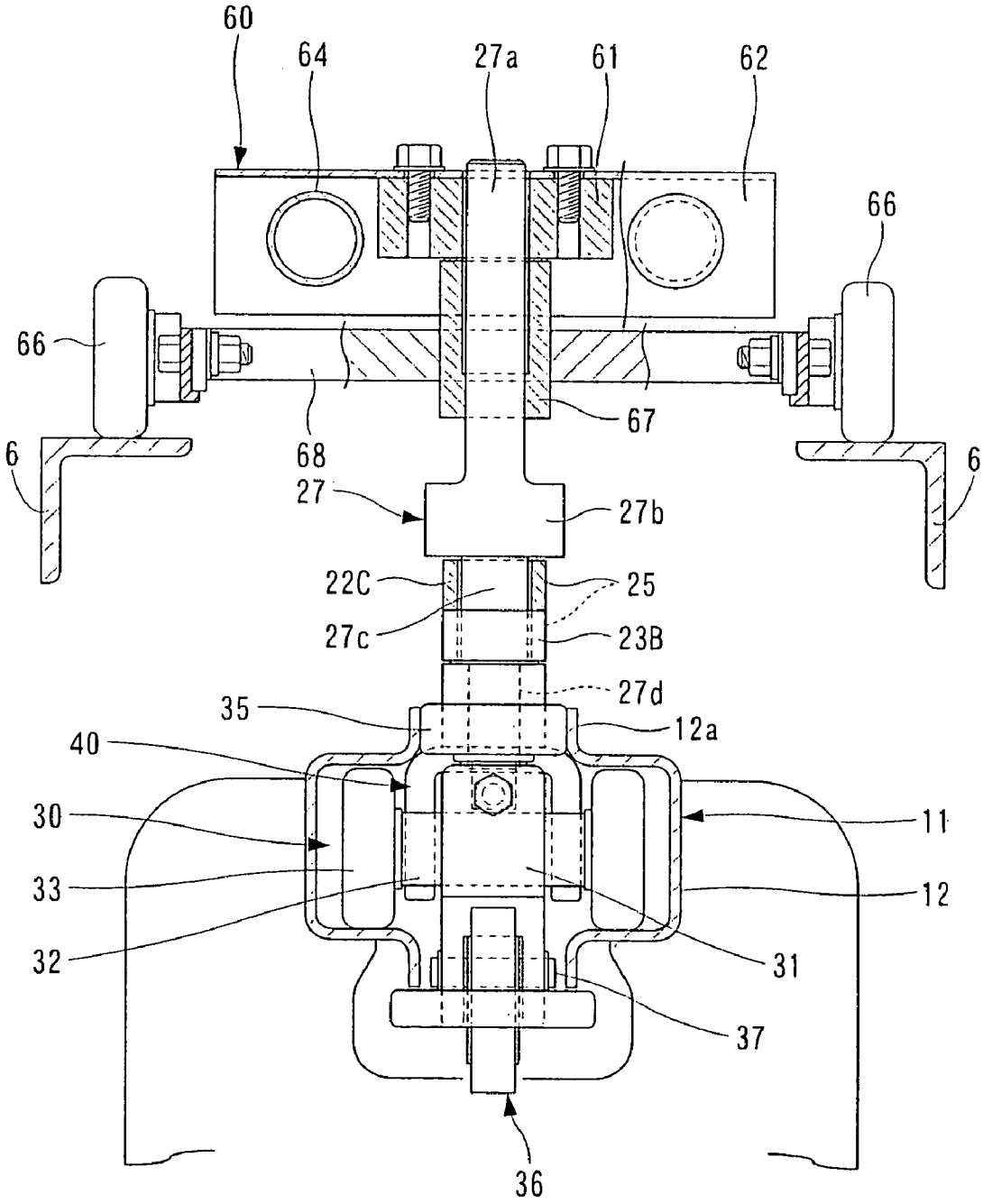
FIG. 6 is a partially cutaway front view of a principal part of a frictional type feed device section in the conveyance apparatus using movable bodies.
Figure 7:
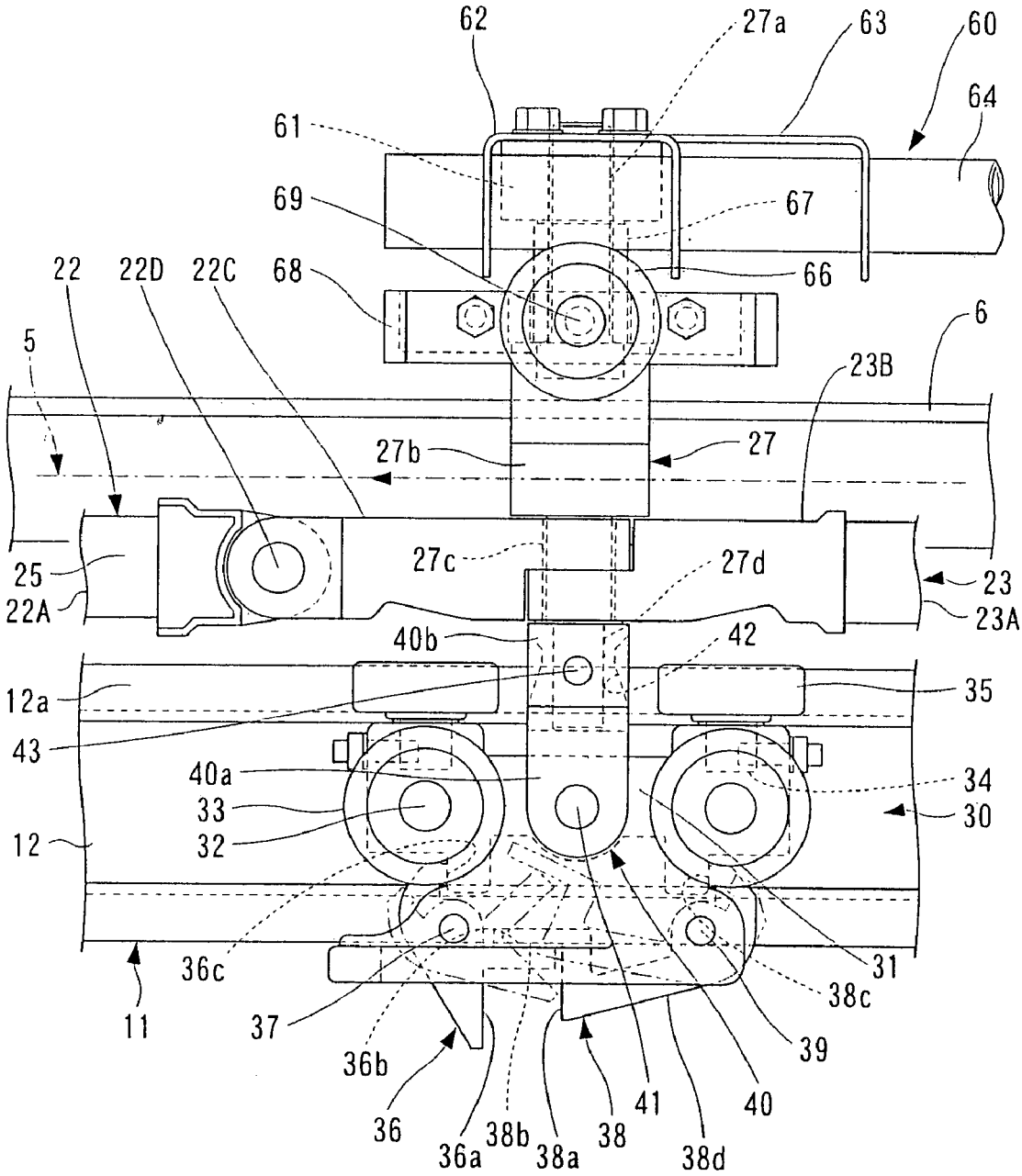
FIG. 7 is a side view of the principal part of the conveyance apparatus using movable bodies.
Figure 8:
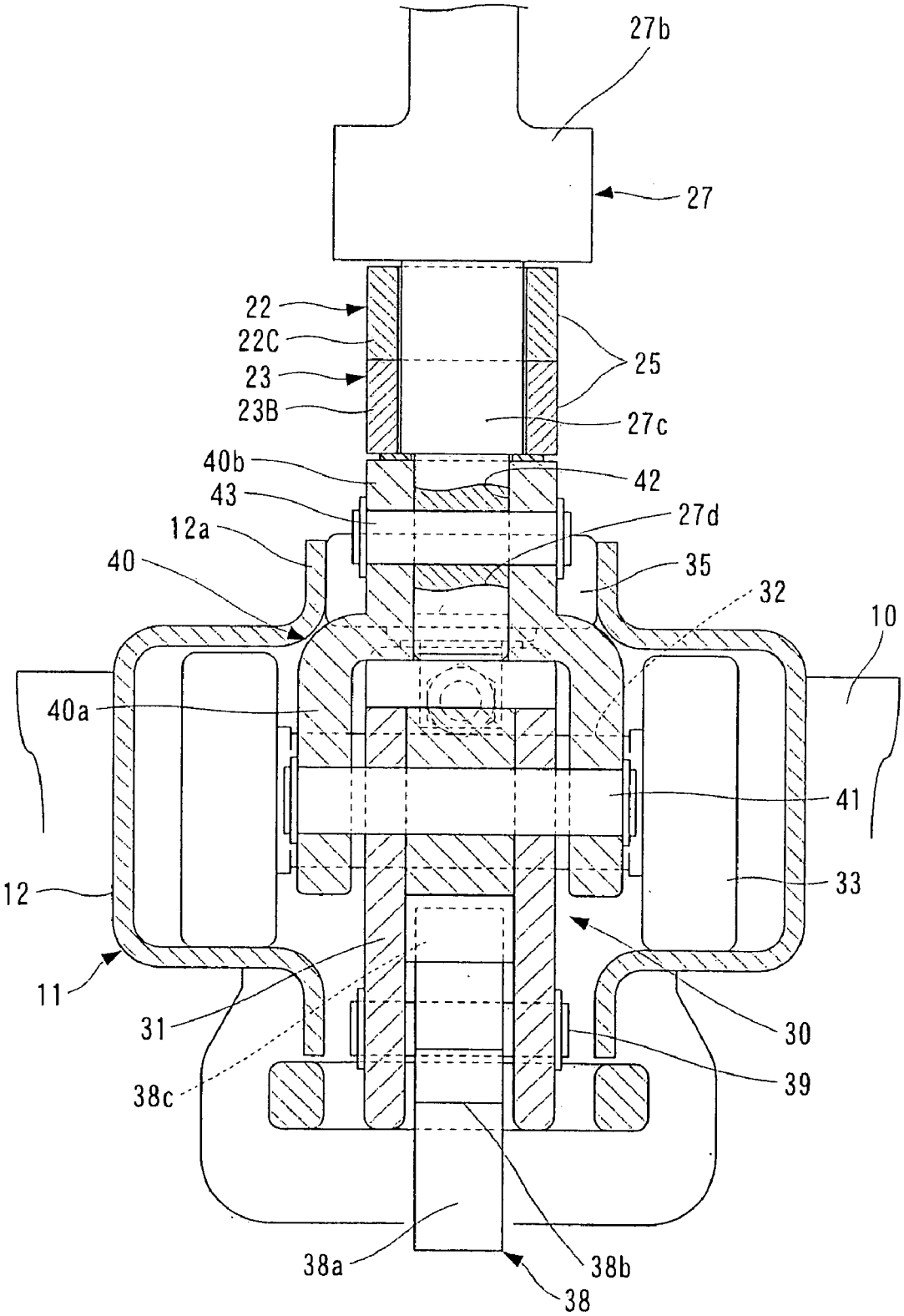
FIG. 8 is a partially cutaway front view of the principal part of the frictional type feed device section in the conveyance apparatus using movable bodies.

In other words, a chain 74 is moved by the drive device 73, by means of respective gear wheels 71, 72. The transmitting body 82 which moves in unison with the chain 74 moves from the start section of the path of action, towards the passive body 36, and firstly, it abuts against the cam surface 38*d* of the shudder preventing body 38, whereby the shudder preventing body 38 is caused to swing upwards about the horizontal pin 39, as illustrated by the dotted line in FIG. 7, and hence the transmitting body 82 passes by the shudder preventing body 38 section. The transmitting body 82 then abuts against the passive surface 36*a* of the passive body 36, as shown in FIG. 4, whereby the movable body 20 is caused to move in a unified manner.

Whilst the movable body 20 is moved inside the drying over 9 in this manner, a drying operation is carried out by drying means (not illustrated) with respect to the conveyed item W supported on the supporting unit 60. In this case, since the endless rotary type feed device 70 is designed such that only the chain 74 moves inside the drying oven 9, a feed configuration that is highly resistant to temperature, and the like, can be obtained, and hence stable operation over a long period can be anticipated. Moreover, if the movable body 20 starts to shudder (vibrate back and forth) when caused to move by means of the transmitting body 82 abutting against the passive surface 36*a* of the passive body 36, then the shudder preventing surface 38*a* of the shudder preventing body 38 abuts against the transmitting body 82 and thus prevents shudder from occurring.

When the movable body 20 reaches the output section of the drying oven 9, the transmitting member 82 moves downwards with respect to the passive body 36, by means of the rail 15 of the chain guide device 14 being formed in a downward sloping shape, for example, and therefore, the transmitting member 82 is disengaged from the passive body 36. Consequently, the feeding force provided by the endless rotary type feed device 70 is released, and thereafter, motive force is imparted by the frictional type feed devices 90, such as those described above.

At a suitable point after leaving the section of the drying oven 9, the conveyed item W on which work tasks have been completed is unloaded from the supporting unit 60, and a new conveyed item W is loaded onto the supporting unit 60. In this way, the movable body 20 performs a circulatory movement along the fixed path 5.

In this circulatory movement, the entire load of the conveyed item W and the supporting unit 60 is transmitted directly to the two middle section guided devices 30, via the front and rear vertical shafts 27, and is supported by the rail device 11 via the supported rollers 33 provided at the front and the rear of the trolley main body 31, by means of which the movement of the movable body 20 can be performed stably at all times, regardless of whether or not there is a load, and irrespective of the size of the load being conveyed.

Figure 12A:
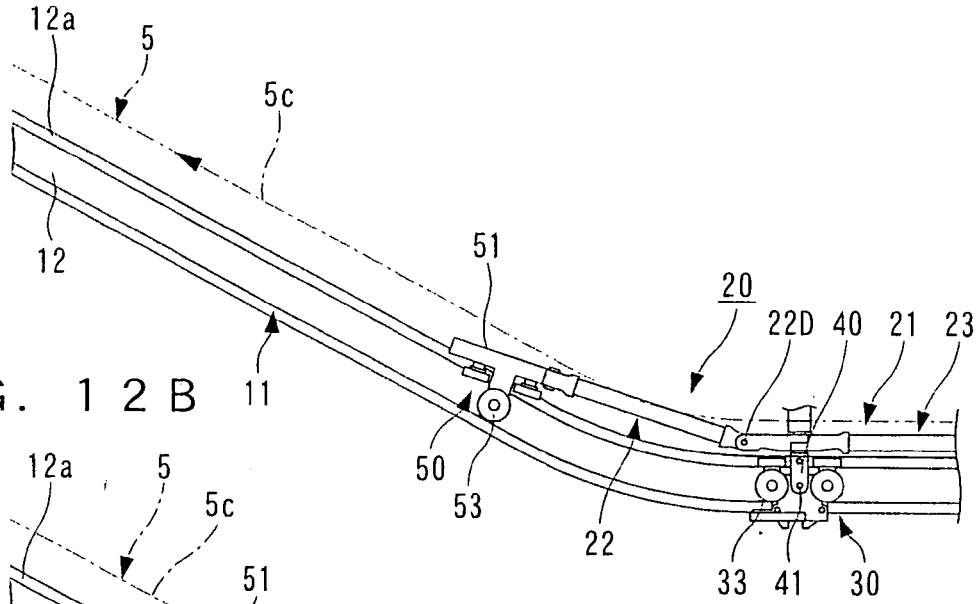
FIG. 12A is a side view of a principal part of the ascending/descending path section in the conveyance apparatus using movable bodies upon start of entry into this section.
Figure 12B:
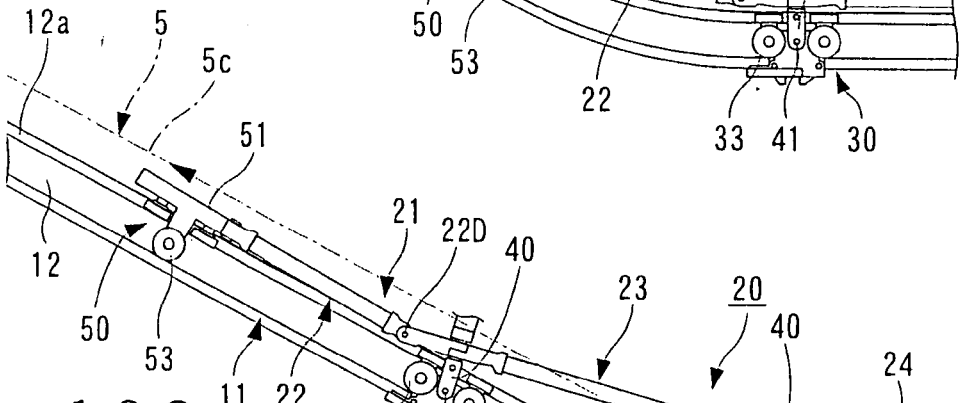
FIG. 12B is a side view of the principal part of the ascending/descending path section at an intermediate stage of the entry.
Figure 12C:
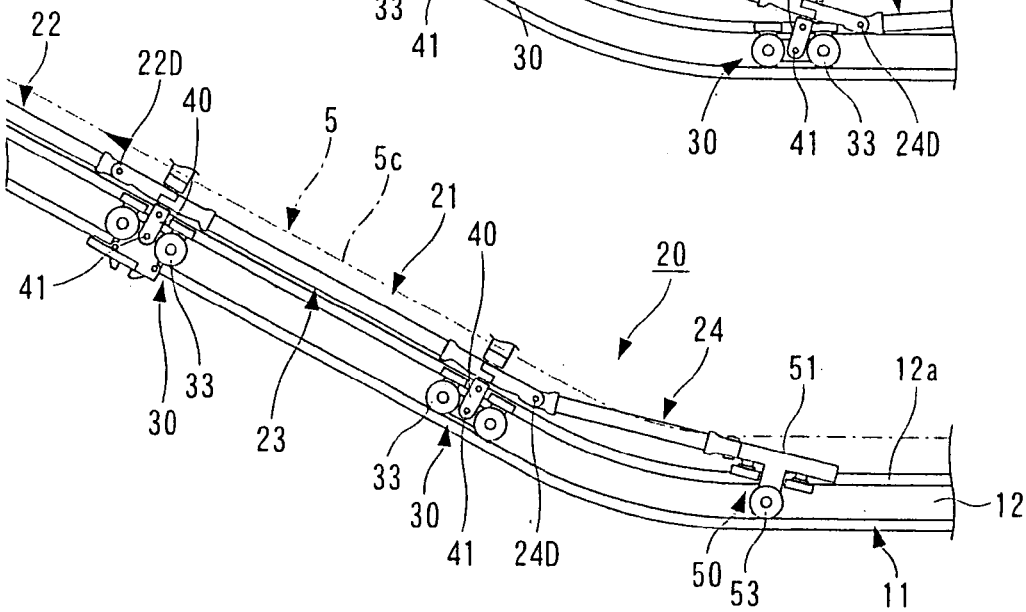
FIG. 12C is a side view of the principal part of the ascending/descending path section upon ending the entry.
Figure 13:
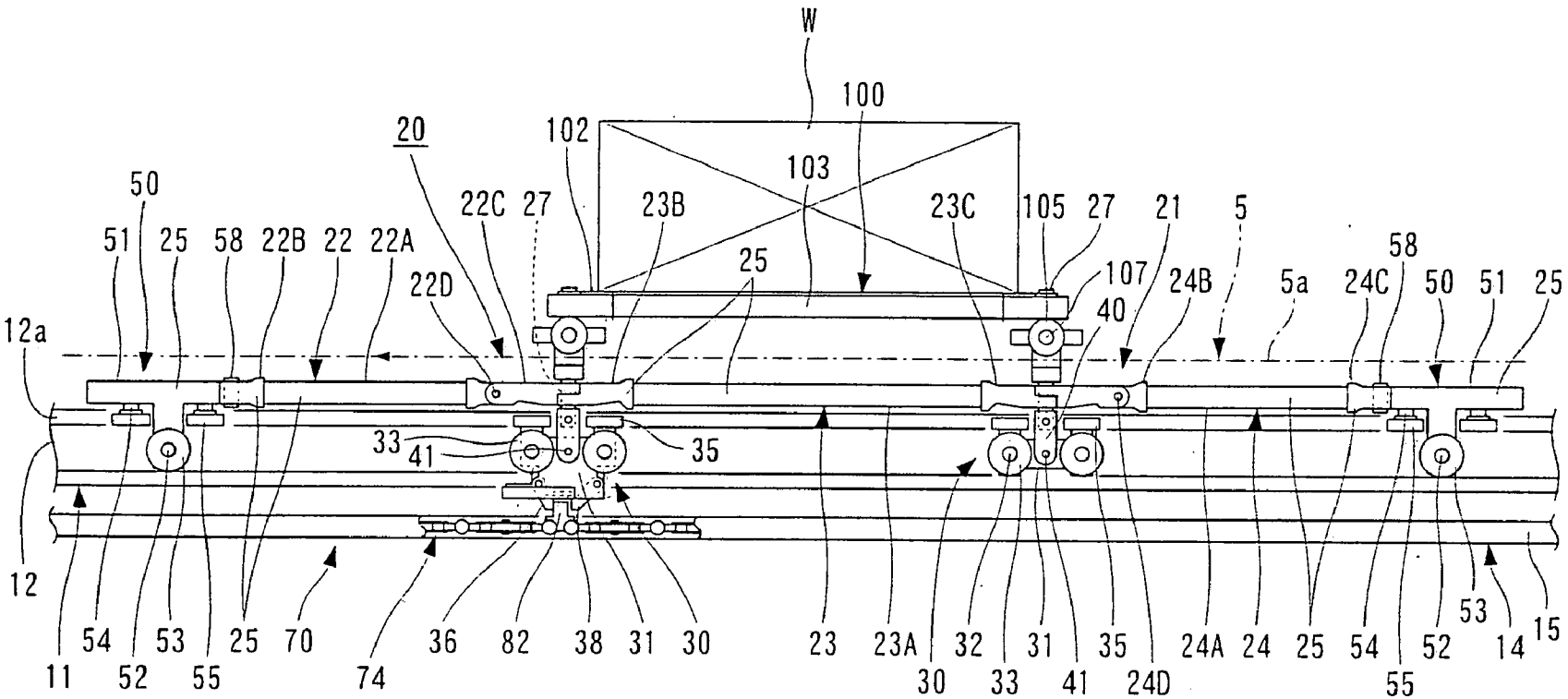
FIG. 13 is a partially cutaway side view of a principal part of a conveyance apparatus using movable bodies according to a second embodiment of the present invention.
Figure 14A:
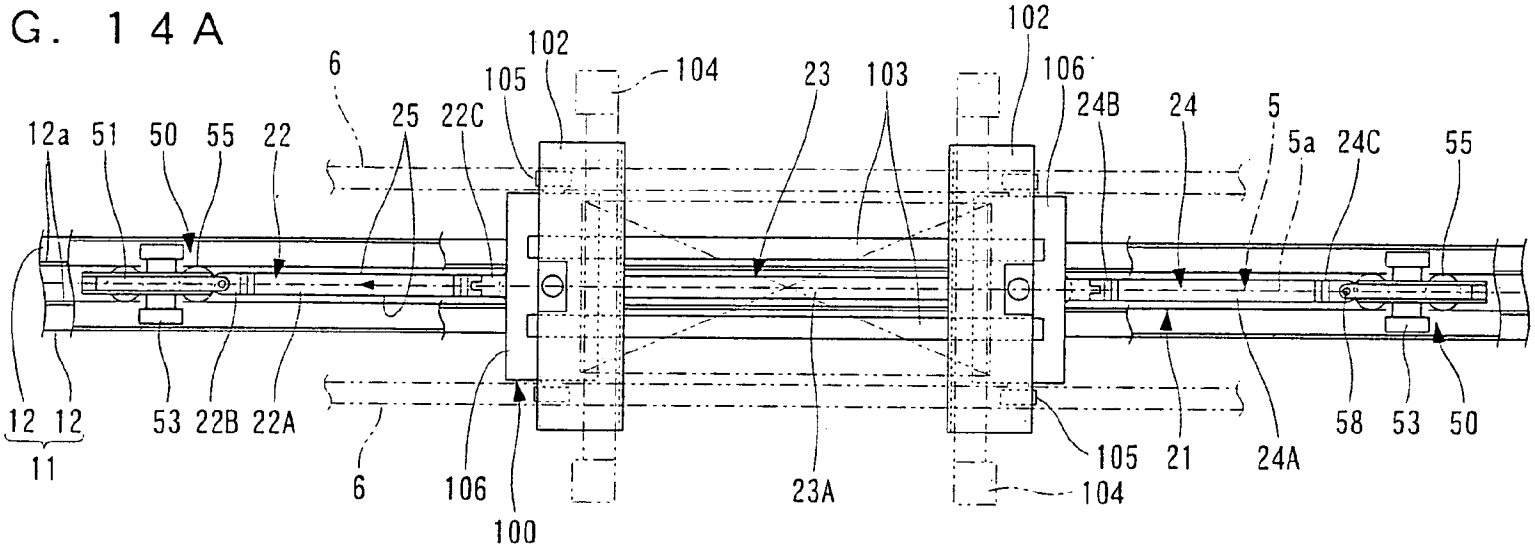
FIG. 14A is a partially cutaway plan view of the principal part of the conveyance apparatus using movable bodies.
Figure 14B:
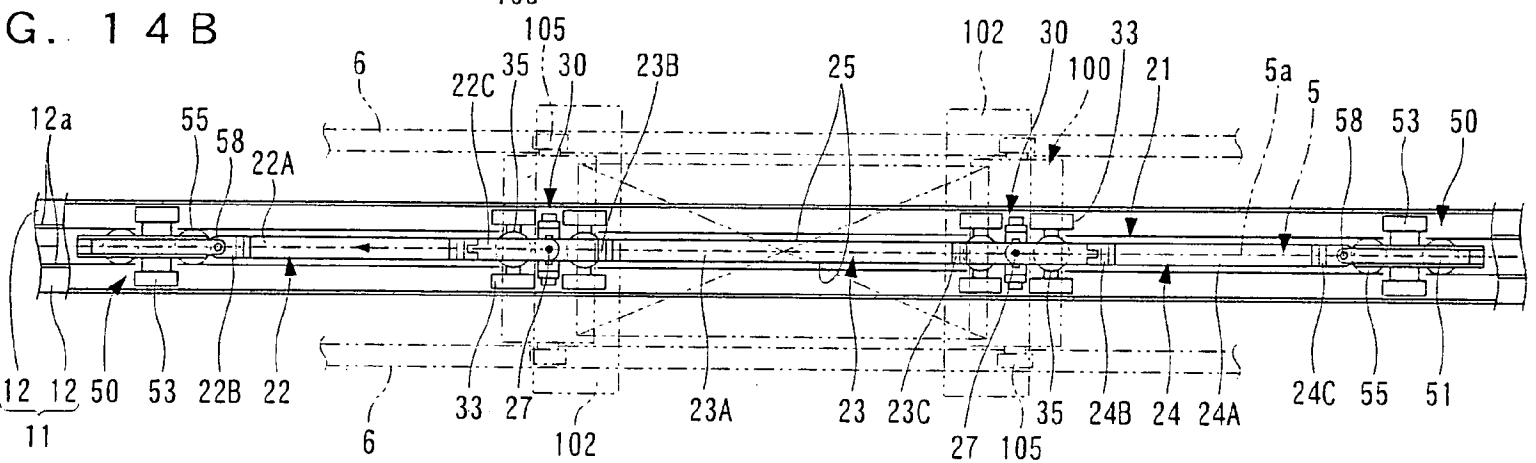
FIG. 14B is a plan view in horizontal section of the principal part of the conveyance apparatus using movable bodies.
Figure 15:
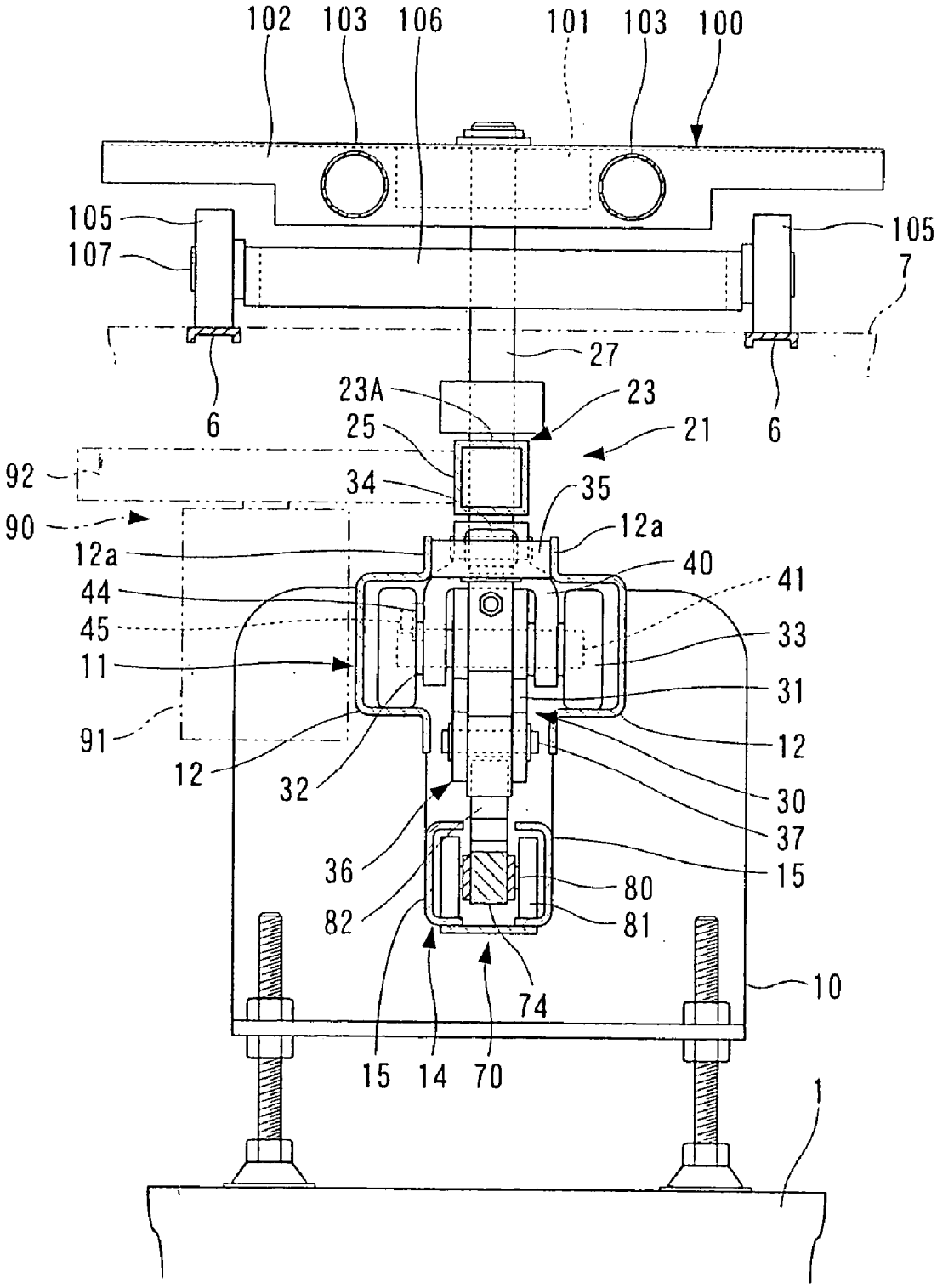
FIG. 15 a partially cutaway front view of a principal part of an endless rotary type feed device section in the conveyance apparatus using movable bodies.
Figure 16:
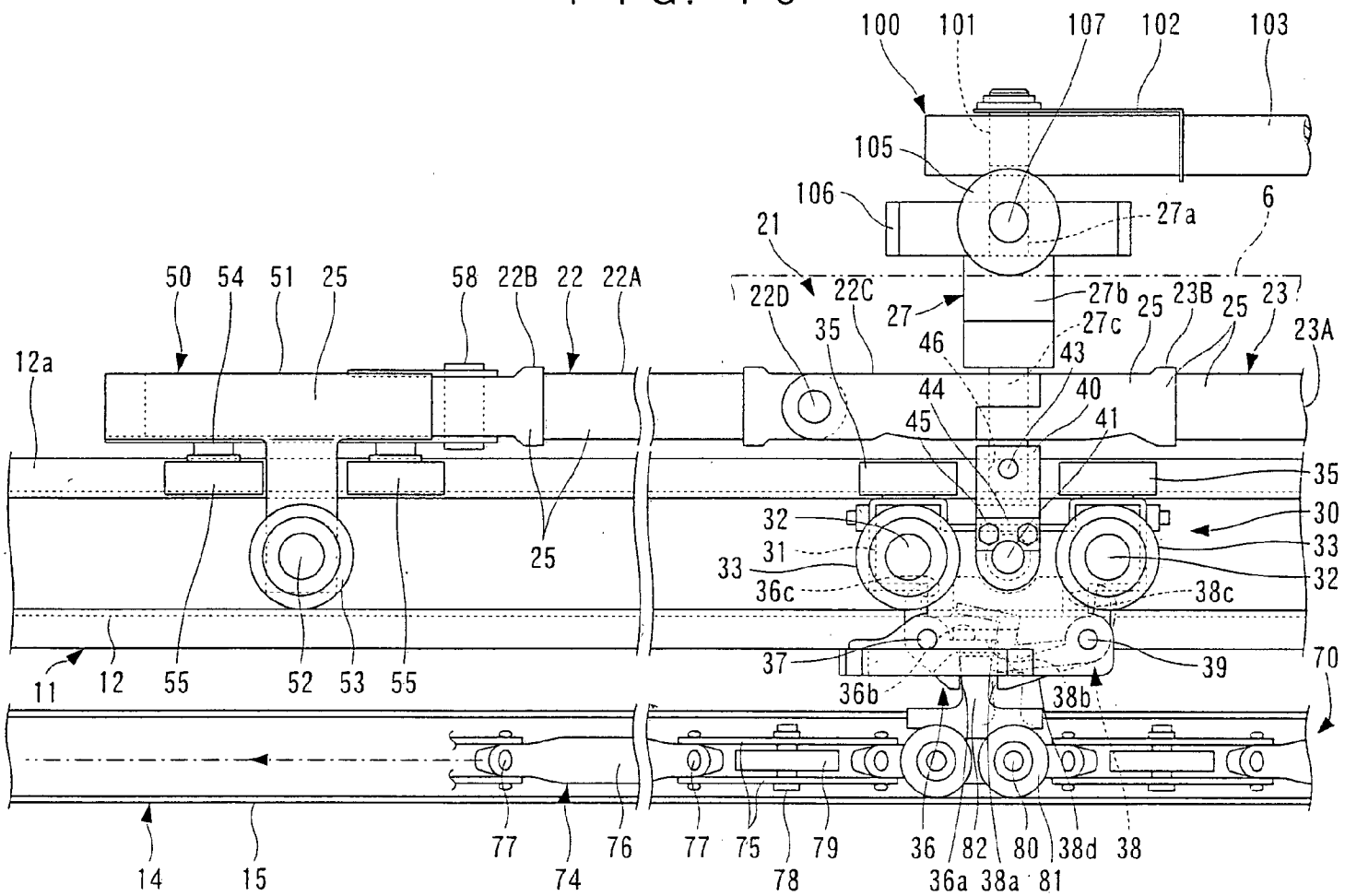
FIG. 16 is a partially cutaway side view of the principal part of the endless rotary type feed device section in the conveyance apparatus using movable bodies.
Figure 17:
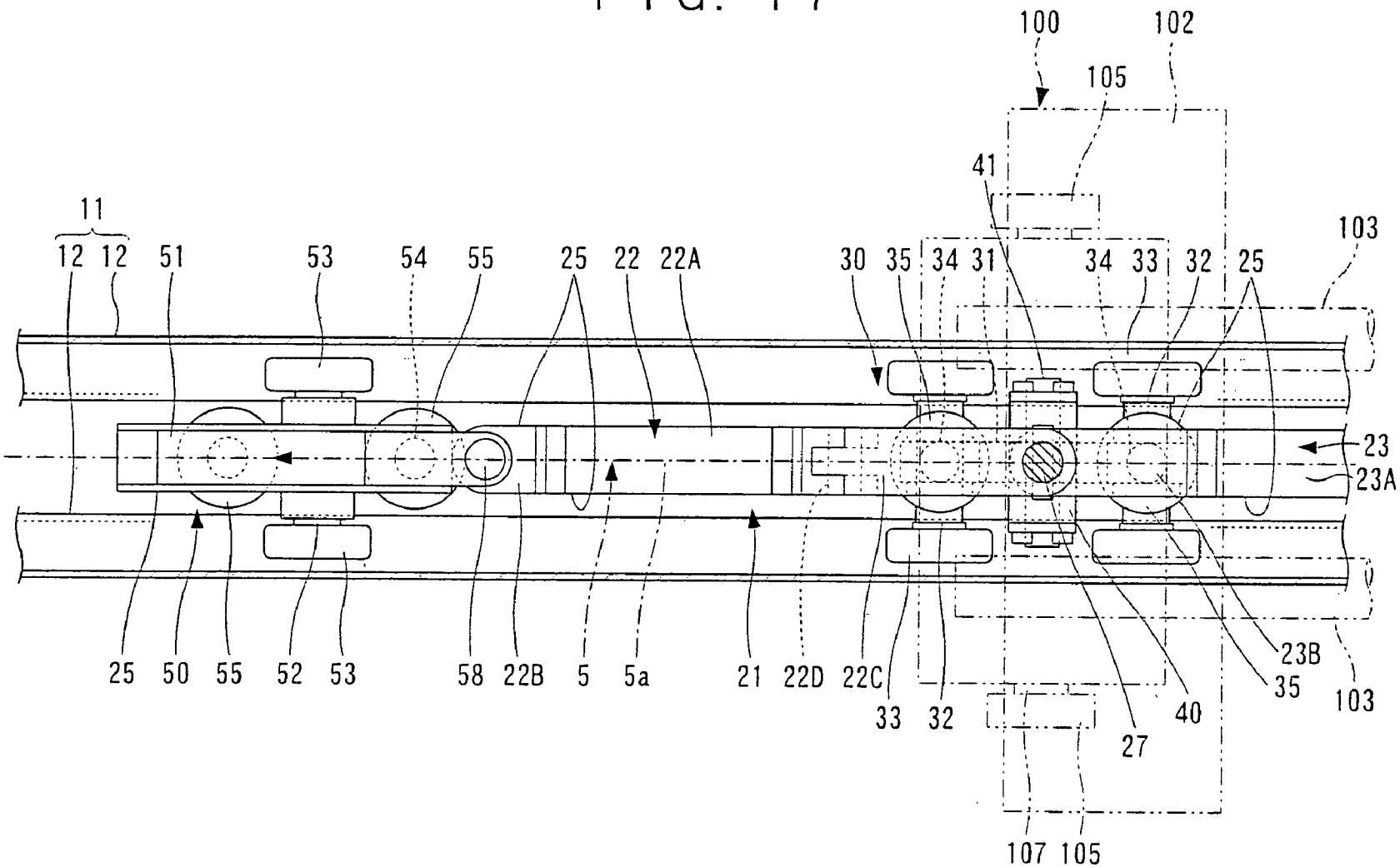
FIG. 17 is another partially cutaway plan view of the principal part of the conveyance apparatus using movable bodies.

Moreover, if an ascending/descending path section 5*c* is formed in an upward or downward direction in side view, in the fixed path 5, then firstly, when the front section guided device 50 moves from the curved section into the inclined section, as shown in FIG. 12(*a*), the front frame body 22 tilts upwards about the lateral pin 22D. Thereupon, when the foremost of the middle section guided devices 30 moves from the curved section into the inclined section, as shown in FIG. 12(*b*), the front and rear middle section guided devices 30 are respectively rotated relatively about the lateral axles 41, with respect to the brackets 40 on the vertical shaft 27. When the rear end section guided device 50 moves from the curved section into the inclined section, as shown in FIG. 12(*c*), the rear frame body 24 tilts upwards about the lateral pin 24D.

Thereby, as the movable body 20 is introduced into the ascending/descending path section 5*c*, the orientation (upward or downward tilt) of the end section guided devices 50 and the middle section guided devices 30 changes automatically in accordance with the gradient of the rails 12 in the ascending/descending path section 5*c*, and as shown in FIG. 11, the movable body 20 moves smoothly up the ascending/descending path section 5*c*. When the movable body 20 exits from an ascending/descending path section 5*c*, similar movement is performed, with the direction of tilting being opposite. Moreover, similar movement is also performed if the ascending/descending path section 5*c* is a descending path.

When the movable body 20 moves in this way, by setting the angle of gradient $\theta$ of the ascent or descent in the ascending/descending path section 5*c* such that is a smaller angle, the longer the distance $L\alpha$ between the supported rollers 53 in the front and rear end section guided devices 50, the entrance into and exit from an upward or downward ascending/descending path section 5*c* by the movable body 20 is carried out smoothly at all times, by means of a free tilting movement about the lateral pin 24D and the lateral axle 41.

Next, a second embodiment of the present invention is described on the basis of FIG. 13 to FIG. 18.

In this second embodiment, the lateral axle 41 is prevented from being removed, by means of a key plate 44, bolt 45, and the like. A recess section 46 which is open on the upper side is formed in the upper part of the bracket 40. The lower part of the vertical shaft 27 fits into this recess section 46, and a lateral pin 43 is passed from the bracket 40 and through the vertical shaft 27. Thereby, the trolley main body 31 of the middle section guided device 30 is connected, in a relatively rotatable fashion, to the lower part of the vertical shaft 27, in other words, to the main body 21, by means of the lateral axle 41. A pair of right and left-hand supported rollers 33 and guided rollers 35 are provided in a distributed fashion to the front and to the rear of the vertical shaft 27.

A supporting unit 100 provided on top of and between the front and rear pair of vertical shafts 27 is constituted by a bracket body 101 fixed to the upper part of each vertical shaft 27, a supporting piece 102 for the conveyed item W, provided on top of each bracket body 101, and a right and left-hand pair of longitudinal members 103 provided between the front and rear supporting pieces 102, and the like. Large-width supports 104 are provided detachably on the front and rear supporting pieces 102. One example of a supporting unit 100 is constituted by the aforementioned elements 101 to 104, and the like.

Idle wheels (guide rollers) 105 are installed on a portion of the aforementioned supporting unit 100. More specifically, a right and left-hand pair of plate shaped members 106 are provided between the front and rear supporting pieces 102, in a state where they are positioned to the outer side of the longitudinal members 103. Axles 107 are provided projecting outwards in a leftward and rightward direction from the front and rear ends of these plate shaped members 106, and the idle wheels 105 are installed on these axles 107. A pair of guide rails 6 for supporting and guiding these idle wheels 105 from below are disposed following the fixed path 5.

Below the action according to the second embodiment described above will be explained.

Figure 18:
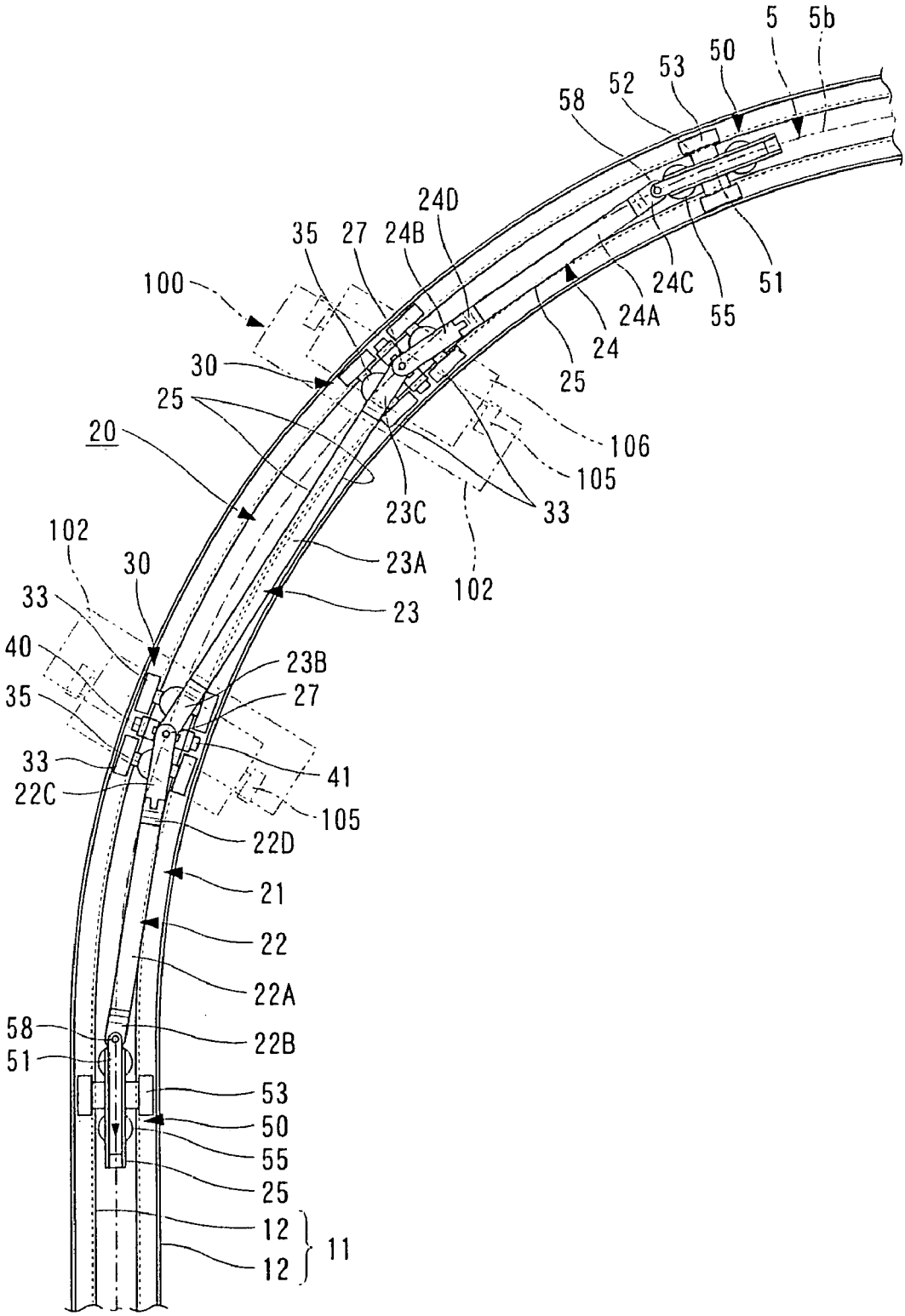
FIG. 18 is a plan view of a laterally curved path section in the conveyance apparatus using movable bodies.

As shown in FIG. 18, when the movable body 20 is moving in a curved path section 5*b* traveling in a leftward or rightward direction, the respective frame bodies 22, 23 24 are moved in a state in which they are each turned with respect to each other, in a leftward or rightward direction, via the vertical shafts 27. Moreover, the end section guided devices 50 are moved in a state in which they are turned with respect to the front and rear frame bodies 22, 24, in a leftward or rightward direction, via the vertical pins 58.

When moving along a curved path section 5*b* of this kind, since the front and rear pair of guided rollers 55 are guided by the guide sections 12*a*, the end section guided devices 50 rotate relatively with respect to the longitudinal direction of the front and rear frame bodies 22, 24, about the vertical pins 58. In this case, the right and left-hand pair of supported rollers 53 provided at one position between the front and rear guided rollers 55 are orientated in parallel with a line linking the respective central axes of the vertical pins 54 on which the front and rear guided rollers 55 are installed, in other words, they are orientated in a direction that is inclined with respect to the direction of movement of the frame bodies 22, 24, and consequently, the supported rollers 53 perform frictional rotation accompanied by slipping (frictional resistance).

However, this frictional rotation does not have a very great effect, because it occurs at one point in the front/rear direction and a total of two points in the lateral direction, and therefore, the end section guided devices 50 are supported and guided without producing any catching, or play, with respect to the rails 12, and hence the movable body 20 can be moved smoothly at all times in a curved path section 5*b*.

At a suitable point after leaving the section of the drying oven 9, the conveyed item W on which work tasks have been completed is unloaded from the supporting unit 100, and a new conveyed item W is loaded onto the supporting unit 100. In this way, the movable body 20 performs a circulatory movement along the fixed path 5. In this circulatory movement, the entire load of the conveyed item W and the supporting unit 100 is transmitted directly to the two middle section guided devices 30, via the front and rear vertical shafts 27, and is supported by the rail device 11 via the supported rollers 33 provided at the front and the rear of the trolley main body 31, by means of which the movement of the movable body 20 can be performed stably at all times, regardless of whether or not there is a load, and irrespective of the size of the load being conveyed.

In the two embodiments described above, the upper edges of the rails 12 of the rail device 11 for supporting and guiding the respective guided devices 30, 50 are bent upwards to form guide sections 12*a* for guiding the guided rollers 35, 55, and hence rails having guide sections can be constituted readily.

In the two embodiments described above, the installation pitch P of the frictional type feed devices 90 is set to a shorter distance than the overall length L of the movable body 20, in other words, these feed devices are installed at prescribed intervals where $P<L$, but it is also possible to install the feed devices by setting P to be $P \approx L$ or $P>L$.

In the two embodiments described above, a mode was described wherein the movable bodies 20 travel in the linear path sections 5*a* in a state where there is an interval between the respective front and rear ends thereof, but if a mode is adopted wherein a frictional type feed device 90 as described above is provided on the upstream side of the linear path section 5*a*, and a braking device imparting a braking force on the movable bodies 20 by acting on the passive surfaces 25 is provided on the downstream side thereof, then it is possible to cause a plurality of movable bodies 20 to move between the frictional type feed device 90 and the braking device, in an aligned fashion, wherein the front end of one trolley main body 51 abuts against the rear end of another trolley main body 51, no gaps arising between the respective front and rear ends of the movable bodies 20, and each movable body 20 being pushed firmly from behind.

In the two embodiments described above, a mode was described in which movable bodies 20 are caused to move by means of an endless rotary type feed device 70 and frictional type feed devices 90, but it is also possible to adopt a mode in which the movable bodies 20 are caused to move by means of either one of these types of feed device only.

In the two embodiments described above, a mode is described in which a passive surface 25 is formed on one side of the main body 21, and a frictional type feed devices 90 which acts on this passive surface 25 are provided, but it is also possible to adopt a mode wherein passive rollers acting on the other side face of the main body 21 are provided, and hence the main body 21 receives a strong frictional force due to being sandwiched from either side, and sufficient motive force can be applied.

In the respective embodiments described above, a mode was described in which the main body 21 of the movable body 20 is constituted by three frame bodies 22, 23, 24, but it is also possible to adopt a mode comprising three or more frame bodies, wherein one or a plurality of frame bodies are connected to the front or the rear of the front frame body 22, or to the front or the rear of the rear frame body 24, or a mode comprising a plurality of middle frame bodies 23. Moreover, it is also possible to adopt a mode comprising a single frame body, with the guided devices 30 being provided on the front and rear ends thereof.

In the two embodiments described above, a mode was described wherein supporting units 60, 100 are provided between the vertical shafts 27 which provide coupling between the frame bodies 22, 23, 24, but it is also possible to adopt a mode wherein supporting units 60, 100 are provided on the middle frame body 23, in which case, an expanding and contracting structure is adopted in the middle frame body 23, in order to achieve smooth movement in curved paths, and the like.

In the two embodiments described above, a rail device 11 and a chain guide device 14, and the like, are provided on a machine frame 10 based on the floor 1, but a composition may also be adopted wherein the rail device 11, chain guide device 14, and the like, are disposed inside a pit provided below floor level. By adopting such as composition, it is possible to reduce the overall height, including the movable bodies 20.

In the two embodiments described above, a movable body 20 capable of moving along the floor 1 was described, but it is also possible to adopt a movable body that is capable of moving by being supported and guided on a rail device installed on the ceiling.

In the two embodiments described above, a composition was described wherein the guide sections 12*a* are formed by bending the rails 12, but it is also possible to adopt a mode wherein channel-shaped rails are used, and guide frame bodies for guiding the guided rollers 35, 55 are fixed to the upper edge portions of the open section thereof.

In the first embodiment described above, a mode was described wherein supported rollers 53 are provided in the end section guided devices 50 at one position in the front/rear direction thereof, but it is also possible to adopt a mode wherein supported rollers are provided in two positions in the front/rear direction, similarly to the middle section guided devices 30, the end section guided devices 50 being connected to the main body by means of brackets having a lower double-arm section, vertical shaft members, and the like.

In the second embodiment described above, the middle section guided devices 30 are installed by means of vertical shaft members 27 which provide coupling between the frame bodies 22, 23, 24, but it is also possible to adopt a mode wherein the middle section guided devices 30 are connected directly to the frame bodies 22, 23, 24. Moreover, a mode can be adopted wherein a supporting unit 100 is provided on the middle frame body 23, in which case an expanding and contracting structure is adopted in the middle frame body 23, in order to achieve smooth movement in curved paths, and the like.

What is claimed is:

1. A conveyance apparatus using movable bodies, comprising:

a rail device;

movable bodies capable of moving along a fixed path by being supported and guided by the rail device, each movable body having a main body side, a front and rear end, and a main body, and each main body comprising a middle section;

a supporting unit for a conveyed item being provided on the main body side of each movable body; and guided devices supported and guided by the rail device, the guided devices being connected to each movable body in the middle section of the main body and at positions corresponding to front and rear ends of the movable body, wherein the guided device in the middle section of the main body is connected in a relatively rotatable fashion via a lateral axle to a lower part of a vertical shaft extending from the main body, the vertical shaft is connected with a lateral roller supporting body rotating integrally with the vertical shaft, and guiding rollers are provided at the right and left-hand ends of the roller supporting body, the guiding rollers being supported and guided by guide bodies disposed at prescribed positions in the fixed path.

2. The conveyance apparatus using movable bodies according to claim 1, wherein the main body of each movable body comprises three or more frame bodies connected in a relatively rotatable fashion via vertical shafts, the frame bodies comprising a front frame body, a rear frame body and a middle section composed of frame bodies between the front and rear frame bodies, the main body is connected with guided devices at positions corresponding to the front and rear ends of each frame body, and at least the guided devices in the middle section of the main body are connected in a relatively rotatable fashion to the lower parts of the vertical shafts via lateral axles.

3. The conveyance apparatus using movable bodies according to claim 1, wherein guide bodies are disposed in a curved path section of the fixed path.

4. The conveyance apparatus using movable bodies according to claim 1, wherein the guided devices have a trolley main body connected to the main body, and supported rollers supported and guided by the rail device and guided rollers guided by the rail device are provided respectively in a distributed fashion at the front and rear of the trolley main body.

5. The conveyance apparatus using movable bodies according to claim 1, wherein the supporting unit is provided between the upper parts of the vertical shafts.

6. The conveyance apparatus using movable bodies according to claim 1, wherein a passive body is provided on each movable body, and an endless rotary type feed device is provided in another prescribed location of the fixed path, the feed device imparting motive force to the movable body by means of a transmitting body engaging with and acting on the passive body.

7. The conveyance apparatus using movable bodies according to claim 1, wherein a laterally-orientated passive surface is formed on each movable body, and frictional type feed devices are provided in prescribed positions of the fixed path, the frictional type feed devices imparting motive force to the movable body by abutting against and transmitting a rotational action to the laterally-orientated passive surface.

8. A conveyance apparatus using movable bodies, comprising:

a rail device;

movable bodies capable of moving along a fixed path by being supported and guided by this rail device, each movable body having a main body side, a front and a rear end, and a main body, each main body having a middle section;

a supporting unit for a conveyed item being provided on the main body side of each movable body; and guided devices supported and guided by the rail device, the guided devices being connected to each movable body in the middle section of the main body and at positions corresponding to front and rear ends of the movable body, wherein the guided device in the middle section of the main body is connected in a relatively rotatable fashion about a lateral axle, to a lower double-arm section of a bracket connected to the lower part of a vertical shaft extending from the main body, with a trolley main body fitted in the lower double-arm section, and the trolley main body includes a pair of right and left-hand supported rollers supported and guided respectively by the rail device, in a distributed fashion in a front and rear direction with respect to the vertical shaft, and a passive body is provided on a lower front portion of the trolley main body in a vertically swingable fashion by means of a horizontal pin, the passive body engaging with a transmitting member of a chain guide device, and a shudder preventing body is provided on a lower rear portion of the trolley main body in a vertically swingable fashion by means of a horizontal pin.

9. The conveyance apparatus using movable bodies according to claim 8, wherein the main body of each movable body comprises three or more frame bodies connected in a relatively rotatable fashion via vertical shafts, the main body is connected with guided devices supported and guided by the rail device at positions corresponding to the front and rear ends of each frame body, and at least the guided devices in a middle section of the main body are connected to the lower parts of the vertical shafts by means of brackets each having lower double-arm sections.

10. The conveyance apparatus using movable bodies according to claim 8, wherein the trolley main body of each guided device connected to the lower part of the vertical shaft includes guided rollers respectively guided by the rail device, in a distributed fashion in a front and rear direction with respect to the vertical shaft.

11. A conveyance apparatus using movable bodies according to claim 8, wherein the main body of each movable body comprises three or more frames bodies connected to each other in a relatively rotable fashion via vertical shafts; and the guided devices in end sections of the main body each comprises a trolley main body connected to the main body, wherein a horizontal pin is passed through and fixed to a low position on the trolley main body at one point in the front/rear direction thereof, the supported rollers are provided in an idly rotatable fashion on both projecting sections of the horizontal pin, and the guided rollers guided by the rail device are provided in a distributed fashion in a front and rear direction with respect to the supported rollers; and the movable main body and the end section guided device each have a passive surface that is abutted against by a feeder roll to impart a motive force to the movable body and the guided device.

12. The conveyance apparatus using movable bodies according to claim 11, wherein the trolley main body of the guided devices in the middle section is connected in a relatively rotatable fashion to the lower part of a vertical shaft via a lateral axle, the supported rollers and guided rollers are provided respectively in a distributed fashion to the front and rear of the vertical shaft, and the supporting unit is provided between the upper parts of the vertical shafts.

13. The conveyance apparatus using movable bodies according to claim 11, wherein the frame bodies located in the front and rear sections are formed to be capable of freely tilting vertically each about a lateral pin, and the trolley main body of the end section guided devices is connected in a relatively rotatable fashion to the free end of each of the frame bodies via a vertical pin.

14. The conveyance apparatus using movable bodies according to claim 13, wherein an angle of gradient in an ascending or descending path section of the fixed path is set to become smaller as the distance between the supported rollers in each of the front and rear end section guided devices becomes greater.

15. The conveyance apparatus using movable bodies according to claim 8, wherein the supporting unit is provided between the upper parts of the vertical shafts.

16. The conveyance apparatus using movable bodies according to claim 11, wherein the supporting unit is provided between the upper parts of the vertical shafts.

17. The conveyance apparatus using movable bodies according to claim 8, wherein a passive body is provided on each movable body, and an endless rotary type feed device is provided in another prescribed location of the fixed path, the feed device imparting motive force to the movable body by means of a transmitting body engaging with and acting on the passive body.

18. The conveyance apparatus using movable bodies according to claim 11, wherein a passive body is provided on each movable body, and an endless rotary type feed device is provided in another prescribed location of the fixed path, the feed device imparting motive force to the movable body by means of a transmitting body engaging with and acting on the passive body.

19. The conveyance apparatus using movable bodies according to claim 8, wherein a laterally-orientated passive surface is formed on each movable body, and frictional type feed devices are provided in prescribed positions of the fixed path, the frictional type feed devices imparting motive force to the movable body by abutting against and transmitting a rotational action to the laterally-orientated passive surface.

20. The conveyance apparatus using movable bodies according to claim 11, wherein a laterally-orientated passive surface is formed on each movable body, and frictional type feed devices are provided in prescribed positions of the fixed path, the frictional type feed devices imparting motive force to the movable body by abutting against and transmitting a rotational action to the laterally-orientated passive surface.

* * * * *